US010840052B2

(12) United States Patent
Ok et al.

(10) Patent No.: US 10,840,052 B2
(45) Date of Patent: Nov. 17, 2020

(54) PLANAR GATE-INSULATED VACUUM CHANNEL TRANSISTOR

(71) Applicant: International Business Machines Corporation, Armonk, NY (US)

(72) Inventors: Injo Ok, Loudonville, NY (US); Choonghyun Lee, Rensselaer, NY (US); Soon-Cheon Seo, Glenmont, NY (US); Seyoung Kim, Weschester, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/991,471

(22) Filed: Jun. 22, 2018

(65) Prior Publication Data

US 2019/0393012 A1 Dec. 26, 2019

(51) Int. Cl.

| | |
|---|---|
| ***H01J 21/10*** | (2006.01) |
| ***H01J 19/068*** | (2006.01) |
| ***H01J 9/04*** | (2006.01) |

(52) U.S. Cl.

CPC ..... *H01J 21/105* (2013.01); *H01J 9/042* (2013.01); *H01J 19/068* (2013.01)

(58) Field of Classification Search

CPC ..... H01J 21/105; H01J 19/068; H01J 9/042; H01L 29/78642; H01L 29/78696

See application file for complete search history.

(56) References Cited

U.S. PATENT DOCUMENTS

| | | | |
|---|---|---|---|
| 5,247,223 | A | 9/1993 | Mori et al. |
| 5,268,649 | A | 12/1993 | Calcatera |
| 5,386,172 | A | 1/1995 | Komatsu |
| 7,494,858 | B2 | 2/2009 | Bohr et al. |

(Continued)

FOREIGN PATENT DOCUMENTS

| | | |
|---|---|---|
| WO | 2016182080 | 11/2016 |

OTHER PUBLICATIONS

Packan et al., "High Performance 32nm Logic Technology Featuring 2nd Generation High-k + Metal Gate Transistors", IEDM09 pp. 659-662 2009.

(Continued)

*Primary Examiner* — Charles D Garber
*Assistant Examiner* — S M Sohel Imtiaz
(74) *Attorney, Agent, or Firm* — Fleit Intellectual Property Law; Jon Gibbons

(57) ABSTRACT

A current CMOS technology compatible process to create a planar gate-insulated vacuum channel semiconductor structure. In one example, the structure is created on highly doped silicon. In another example, the structure is created on silicon on insulator (SOI) over a box oxide layer. The planar gate-insulated vacuum channel semiconductor structure is formed over a planar complementary metal-oxide-semiconductor (CMOS) device with a gate stack and a tip-shaped SiGe source/drain region. Shallow trench isolation (STI) is used to form cavities on either side of the gate stack. The cavities are filled with dielectric material. Multiple etching techniques disclosed creates a void in a channel in the tip-shaped SiGe source/drain region under the gate stack. A vacuum is created in the void using physical vapor deposition (PVD) in a region above the tip-shaped SiGe source/drain regions.

14 Claims, 18 Drawing Sheets

(56) References Cited

U.S. PATENT DOCUMENTS 9,793,395 B1* 10/2017 Liu ..... H01L 21/30604
9,853,163 B2 12/2017 Zhang
2002/0138813 A1* 9/2002 Teh ..... G06F 30/398 716/112
2006/0057859 A1* 3/2006 Chen ..... H01L 29/7848 438/765
2006/0114628 A1* 6/2006 Fukuda ..... H01L 27/1203 361/56
2009/0140626 A1* 6/2009 Kim ..... H01J 21/10 313/306
2013/0285155 A1* 10/2013 Glass ..... H01L 29/78684 257/369
2015/0214349 A1* 7/2015 Xiao ..... H01L 29/1033 257/29
2016/0043224 A1* 2/2016 Huang ..... H01L 21/823425 257/401
2017/0092778 A1* 3/2017 Zhang ..... H01L 29/78642
2017/0104079 A1* 4/2017 Xiao ..... H01L 21/31144
2017/0104101 A1* 4/2017 Cheng ..... H01L 29/785
2018/0097118 A1* 4/2018 Zhang ..... H01L 29/78642
2018/0102433 A1 4/2018 Liu et al.

OTHER PUBLICATIONS

Choi et al., "Layout Variation Effects in Advanced MOSFETs: STI-Induced Embedded SiGe Strain Relaxation and Dual-Stress-Liner Boundary Proximity Effect", IEEE Transactions on Electron Devices, vol. 57, No. 11 Nov. 2010.

Wang et al., "Correlation Between Random Telegraph Noise and 1/f Noise Parameters in 28-nm pMOSFETs With Tip-Shaped SiGe Source/Drain", IEEE Electron Device Letters, vol. 33, No. 7 Jul. 2012.

Dick James, "Intel Ivy Bridge Unveiled—The First Commercial Tri-Gate, High-k, Metal-Gate CPU", 2012.

Han et al., "Vacuum nanoelectronics: Back to the future?—Gate insulated nanoscale vacuum channel transistor", Applied Physics Letters 100 2012.

* cited by examiner

PLANAR GATE-INSULATED VACUUM CHANNEL TRANSISTOR

BACKGROUND OF THE INVENTION

The present disclosure generally relates to the field of semiconductors, and more particularly relates to complementary metal oxide semiconductor (CMOS) technology, and more specifically, to incorporating vacuum channels into vertical transistors.

CMOS technology is used to construct integrated circuits such as microprocessors, microcontrollers, static random access memory (RAM) and other digital logic circuits. A basic component of CMOS designs is metal oxide semiconductor field effect transistors (MOSFETs). As MOSFETs are scaled to smaller dimensions, various designs and techniques are employed to improve device performance.

New research presents a nanoscale vacuum tube or vacuum transistor fabricated entirely using current silicon integrated circuit manufacturing techniques. Vacuum is better for electron transport than any semiconductor since there is no electron scattering. In addition, vacuum devices are immune to radiation.

Nevertheless, vacuum devices lost out to silicon devices due to ease of large-scale manufacturing, robustness, versatility, and low cost. Here, the best of vacuum and silicon technologies are combined to produce nanoscale vacuum transistors that are amenable to large wafer fabrication and are inexpensive, while providing exceptional performance.

SUMMARY OF THE INVENTION

Disclosed is a novel vacuum structure with tip-shape SiGe source/drain region or sharp tip structure. More specifically disclosed is the use of current CMOS technology compatible process to create a planar gate-insulated vacuum channel semiconductor structure. In one example, the structure is created on highly doped silicon. In another example, the structure is created on silicon on insulator over a box oxide layer.

The planar gate-insulated vacuum channel semiconductor structure is formed by depositing a conformal hard mask liner over a planar complementary metal-oxide-semiconductor (CMOS) device with a gate stack and a tip-shaped SiGe source/drain region. Next, shallow trench isolation (STI) is used to form cavities on either side of the gate stack. Continuing further, the cavities are filled with dielectric material using oxide deposition. Chemical-mechanical planarization (CMP) is used to reach a height of the conformal hard mask liner. A first etching is performed using reactive-ion etching along a first direction cutting the gate stack from a top direction down to approximately the tip-shaped SiGe source/drain region. A second etching is performed using wet etching along a second direction perpendicular to the first direction to create a void in a channel in the tip-shaped SiGe source/drain region under the gate stack. A vacuum is created in the void using physical vapor deposition (PVD) in a region above the tip-shaped SiGe source/drain regions.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention, in which.

DETAILED DESCRIPTION

Terminology

Figure 1B:
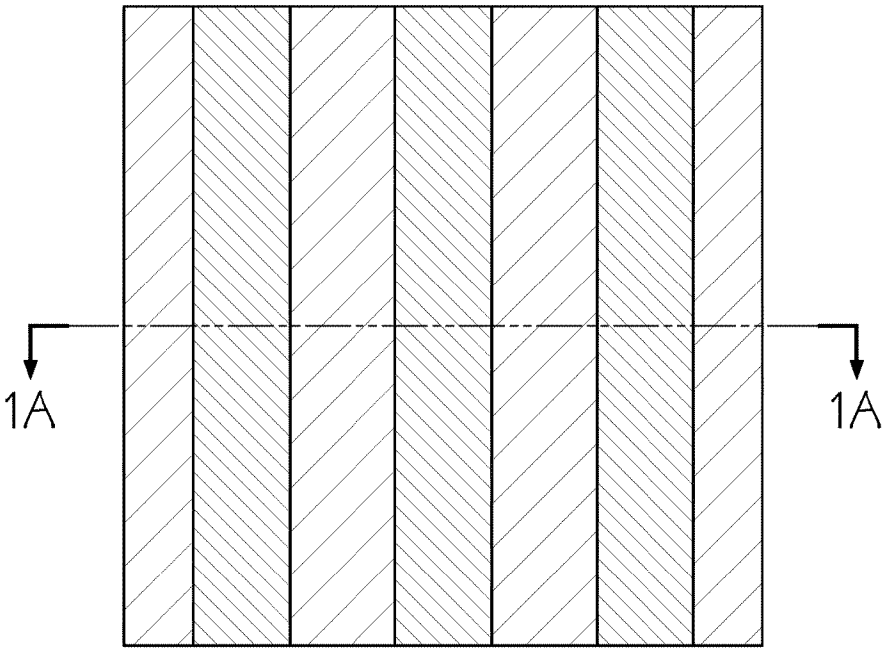
FIG. 1A is a cross-sectional side view of a prior art basic metal oxide semiconductor (MOS) device above a semiconducting substrate and FIG. 1B is a top view of the FIG. 1A.

Embodiments of the present invention are described herein with reference to the related drawings. Alternative embodiments can be devised without departing from the scope of this invention. It is noted that various connections and positional relationships (e.g., over, below, adjacent, etc.) are set forth between elements in the following description and in the drawings. These connections and/or positional relationships, unless specified otherwise, can be direct or indirect, and the present invention is not intended to be limiting in this respect. Accordingly, a coupling of entities can refer to either a direct or an indirect coupling, and a positional relationship between entities can be a direct or indirect positional relationship. As an example of an indirect positional relationship, references in the present description to forming layer "A" over layer "B" include situations in which one or more intermediate layers (e.g., layer "C") is between layer "A" and layer "B" as long as the relevant characteristics and functionalities of layer "A" and layer "B" are not substantially changed by the intermediate layer(s).

The following definitions and abbreviations are to be used for the interpretation of the claims and the specification. As used herein, the terms "comprises," "comprising," "includes," "including," "has," "having," "contains" or "containing," or any other variation thereof, are intended to cover a non-exclusive inclusion. For example, a composition, a mixture, process, method, article, or apparatus that comprises a list of elements is not necessarily limited to only those elements but can include other elements not expressly listed or inherent to such composition, mixture, process, method, article, or apparatus.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection."

References in the specification to "one embodiment." "an embodiment," "an example embodiment," etc., indicate that the embodiment described can include a particular feature, structure, or characteristic, but every embodiment may or may not include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper," "lower," "right," "left," "vertical," "horizontal," "top," "bottom," and derivatives thereof shall relate to the described structures and methods, as oriented in the drawing figures. The terms "overlying," "atop," "on top," "positioned on" or "positioned atop" mean that a first element, such as a first structure, is present on a second element, such as a second structure, wherein intervening elements such as an interface structure can be present between the first element and the second element. The term "direct contact" means that a first element, such as a first structure, and a second element, such as a second structure, are connected without any intermediary conducting, insulating or semiconductor layers at the interface of the two elements. It should be noted that the term "selective to," such as, for example, "a first element selective to a second element," means that the first element can be etched and the second element can act as an etch stop. s used herein, "thickness" refers to a size of an element (e.g., a layer, trench, hole, etc.) in the cross-sectional views measured from a bottom surface to a top surface, or a left side surface to a right side surface of the element, and/or measured with respect to a surface on which the element is directly on.

Unless otherwise specified, as used herein, "height" or "height above a substrate" refers to a vertical size of an element (e.g., a layer, trench, hole, etc.) in the cross-sectional views measured from a top surface of the substrate to a top surface of the element. A thickness of an element can be equal to a height of the element if the element is directly on the substrate. As used herein, "lateral", "lateral side", and "lateral surface" refer to a side surface of an element (e.g., a layer, opening, etc.), such as a left or right side surface in the cross-sectional views herein.

Semiconductor Fabrication Techniques

For the sake of brevity, conventional techniques related to semiconductor device and integrated circuit fabrication may or may not be described in detail herein. Moreover, the various tasks and process steps described herein can be incorporated into a more comprehensive procedure or process having additional steps or functionality not described in detail herein. In particular, various steps in the manufacture of semiconductor devices and semiconductor-based ICs are well known and so, in the interest of brevity, many conventional steps will only be mentioned briefly herein or will be omitted entirely without providing the well-known process details.

Vacuum Channel Transistors

Turning now to a description of technologies that are more specifically relevant to aspects of the present invention, vacuum channel transistors include an open channel region. A vacuum channel transistor can be fabricated by etching a cavity in doped silicon. The cavity is bordered by a source electrode, a gate electrode, and a drain electrode. The source and drain are separated by a space, and the gate is over the space. Electrons are emitted from the source due to a voltage applied across the source and the drain, and the gate controls the electron flow across the cavity. When the space between the source and drain is sufficiently large (e.g., about 150 nm) the electrons do not collide, which means that the mean free path of the electrons (i.e., the average length an electron can travel before hitting something) is more than 1 micrometer.

Vacuum channel transistors are advantageous for several reasons. Compared to other semiconductor transistors, vacuum channel transistors can function at speeds that are many orders of magnitude faster. Vacuum channel transistors can also operate at higher frequencies, for example, terahertz frequencies, which can be beyond the reach of solid-state devices. While electrons in a solid state transistor suffer from collisions with atoms, which is also called crystal-lattice scattering, electrons freely propagate in the open channel space of a vacuum transistor. Additionally, vacuums are not susceptible to radiation damage that can damage semiconductors. Vacuums also produce less noise and distortion than solid-state materials.

Although vacuum channels can be used in planar transistor devices, there are disadvantages compared to using vacuum channels in vertical transistors. For example, the large areas of the source/drain limit the ability to use the devices in integrated circuits. Also, the cathode/anode tips that are made of silicon processing for "electron" thermionic emission are not sharp enough to produce efficient field emissions to justify the power/performance needs for modern transistors.

Accordingly, various embodiments of the present invention provide transistors, and methods of making transistors, with a vertically integrated vacuum channel. Compared to planar devices, the vertical devices described herein have a smaller footprint, for example, of the nanometer scale. In embodiments, vertical vacuum devices also have channel areas that are formed by oxidation processes, which are reliable methods for generating angled channel tips for electron field emission. The described vacuum devices are also fully compatible with state-of-the art CMOS technology, which makes the devices ideal candidates for highly scaled transistor architecture.

It is to be understood that the present disclosure will be described in terms of a given illustrative architecture; however, other architectures, structures, substrate materials and process features and steps may be varied within the scope of the present disclosure.

Referring now to the drawings in which like numerals represent the same of similar elements, FIGS. 1-18 illustrate various processes for fabricating a planar gate-insulated vacuum channel semiconductor devices according to embodiments.

It should be noted that the following process for forming the initial semiconductor structure (e.g., active areas, gate stack, gate spacer, source/drain regions, etc.) is only illustrative. Any process for forming these structures is applicable to embodiments of the present disclosure.

Example 1—Basic Metal Oxide Semiconductor

Figure 1A:
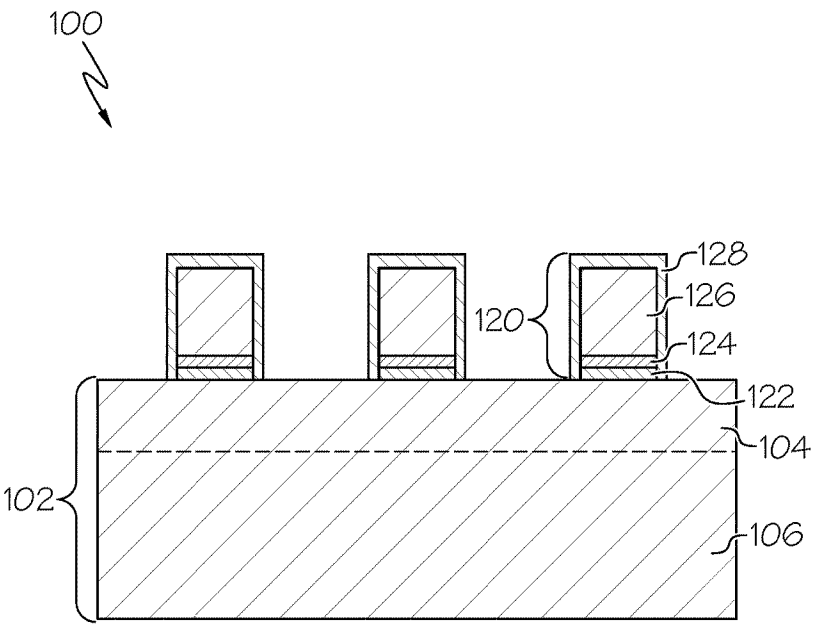

Referring now to FIG. 1A is a cross-sectional view taken along line 1A-1A of FIG. 1B. FIG. 1B is a top view of the FIG. 1A. FIG. 1A illustrates a basic metal oxide semiconductor (MOS) device 100 above a semiconducting substrate 102. Shown is a gate stack 120 with a High-K dielectric 122, a metal gate 124, a contact metal or polysilicon 126, and a SiN cap 128. One skilled in the art will recognize what foregoing processing steps have occurred, the explanation of which will be omitted.

The substrate 102 can include one or more semiconductor materials. In an exemplary embodiment, the substrate 102 includes silicon. Other non-limiting examples of suitable substrate 102 materials include SiC (silicon carbide), Ge (germanium), SiGe (silicon germanium), SiGeC (silicon-germanium-carbon), Si alloys, Ge alloys, III-V materials (e.g., GaAs (gallium arsenide), InAs (indium arsenide), InP (indium phosphide), or aluminum arsenide (AlAs)), II-VI materials (e.g., CdSe (cadmium selenide), CdS (cadmium sulfide), CdTe (cadmium telluride), ZnO (zinc oxide), ZnSe (zinc selenide), ZnS (zinc sulfide), or ZnTe (zinc telluride)), or any combination thereof.

Doping the substrate 102 forms a doped region 104 and undoped region 106 in the substrate 102. The doped region 104 can form source regions and/or drain regions. In addition to doping the substrate 102 as shown, a source/drain can be formed on the substrate 102 by forming an epitaxial growth on the substrate 102 in some embodiments. When dopants are used, the substrate 102 can be heavily doped with one or more dopants. The dopants can be p-type dopants or n-type dopants. is a cross-sectional side view after doping the substrate 102 with a dopant. Doping the substrate 102 forms a doped region 104 in the substrate 102. The doped region 104 can form source regions and/or drain regions. In addition to doping the substrate 102 as shown, a source/drain can be formed on the substrate 102 by forming an epitaxial growth on the substrate 102 in some embodiments. When dopants are used, the substrate 102 can be heavily doped with one or more dopants. The dopants can be p-type dopants or n-type dopants.

Figure 2B:
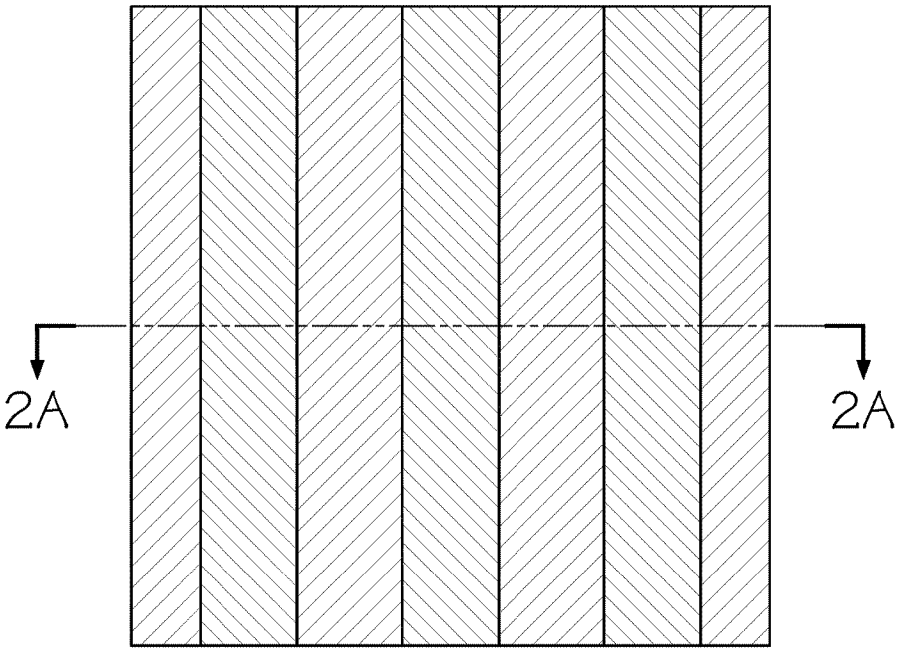
FIG. 2A is a cross-sectional side view of a source/drain formations and FIG. 2B is a top view of the FIG. 2A.
Figure 2A:
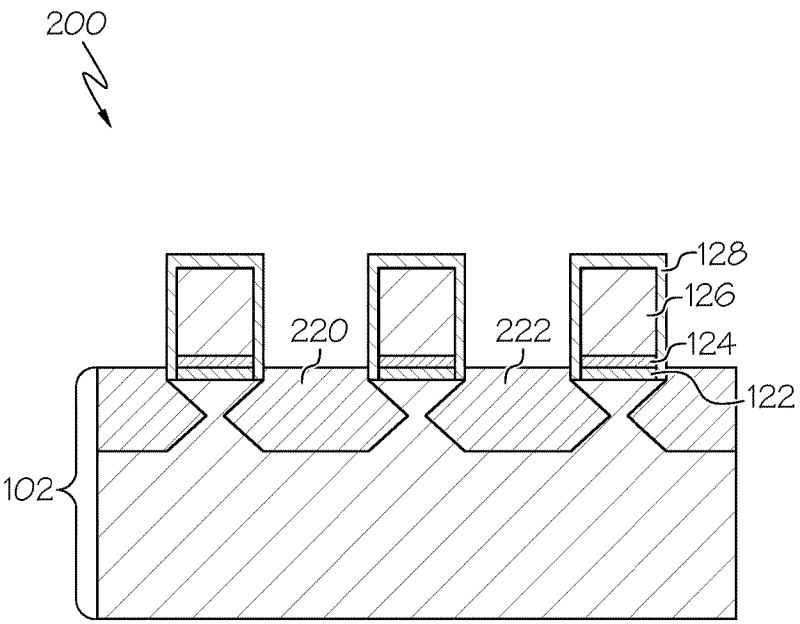

Turning now to FIG. 2A is a cross-sectional view taken along line 2A-2A of FIG. 2B. FIG. 28 is a top view of the FIG. 2A. FIG. 2A illustrates the source 220 and drain 222 are formed in regions that extend laterally beneath the gate stack 120 of the MOS device 200 above a semiconducting substrate 102. Shallow implants and rapid thermal or flash anneal processing techniques may be used to form the tips of the source 220 and drain 222. FIG. 2B is a top view of the FIG. 2A. The etch to form the source 220 and drain 222 regions is a dry etch (e.g., an SF6-based plasma etch). The dry etch of the embodiment forms the "bullet-shaped" or "tip-shaped" or "sharp-tip" source 220 and drain 222 regions as illustrated. The shape, thickness and distance between the source 220 and drain 222 can be controlled to be less than 150 nanometers.

The various components and structures of the device 200 may be formed using a variety of different materials and by performing a variety of known techniques. For example, the sacrificial gate insulation layer 122 may be comprised of silicon dioxide, and the sacrificial gate electrode 126 may be comprised of polysilicon. Of course, those skilled in the art will recognize that there are other features of the transistor 200 that are not depicted in the drawings for purposes of clarity. For example, so-called halo implant regions are not depicted in the drawings, as well as various layers or regions of silicon/germanium that are typically found in high performance PMOS transistors. At the point of fabrication depicted in FIG. 2, the various structures of the device 200 have been formed and a chemical mechanical polishing (CMP) process has been performed to remove any materials above the sacrificial gate electrode 120 such as a protective cap layer (not shown)

SiN Liner and STI Oxide Deposition

Figure 3B:
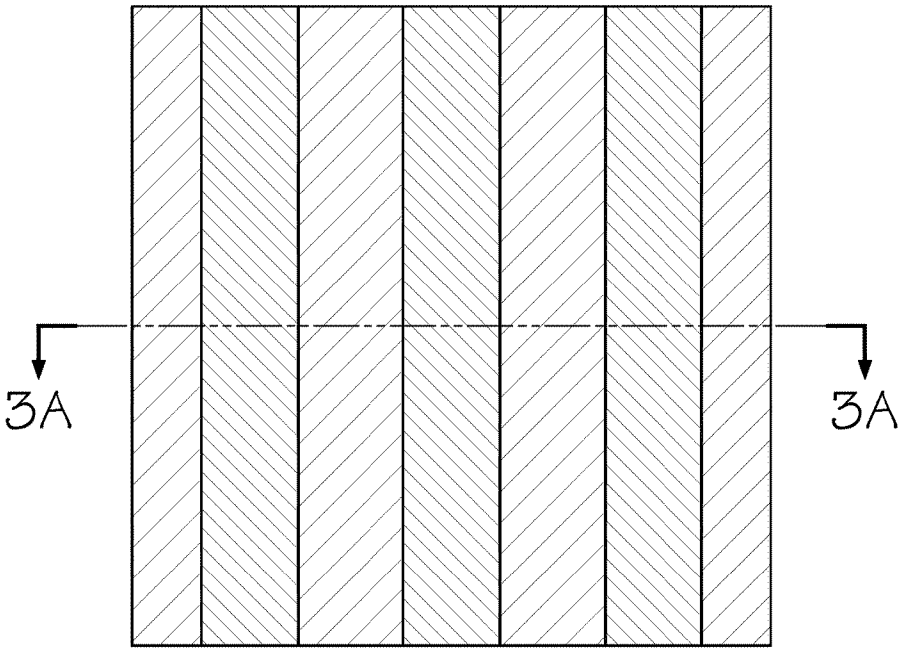
FIG. 3A is a cross-sectional side view of a deposit of a conformal hard mask and FIG. 3B is a top view of the FIG. 3A.
Figure 3A:
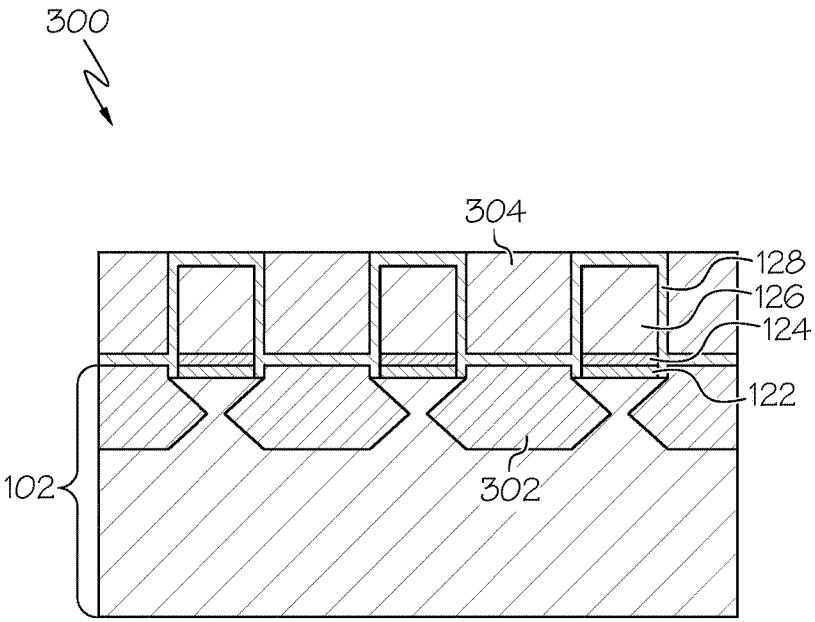

Referring now to FIG. 3A is a cross-sectional view taken along line 3A-3A of FIG. 3B. FIG. 3B is a top view of the FIG. 3A. FIG. 3A illustrates a deposit of a conformal hard mask liner 302, such as silicon nitride (SiN) liner, over the gate stack 120 and the SiGe source 220/drain 222 regions of the MOS device 300 above a semiconducting substrate 102. Following the liner 302 is shallow trench isolation (STI) 304 filing the resulting trenches with a dielectric material 304, such as, silicon dioxide ($SiO_2$). The STI step is typically followed by a chemical-mechanical planarization (CMP) process resulting in the structure 300 as shown to the height of the SiN cap 128.

First Etching Steps to Cut the Gate Stack

Figure 4B:
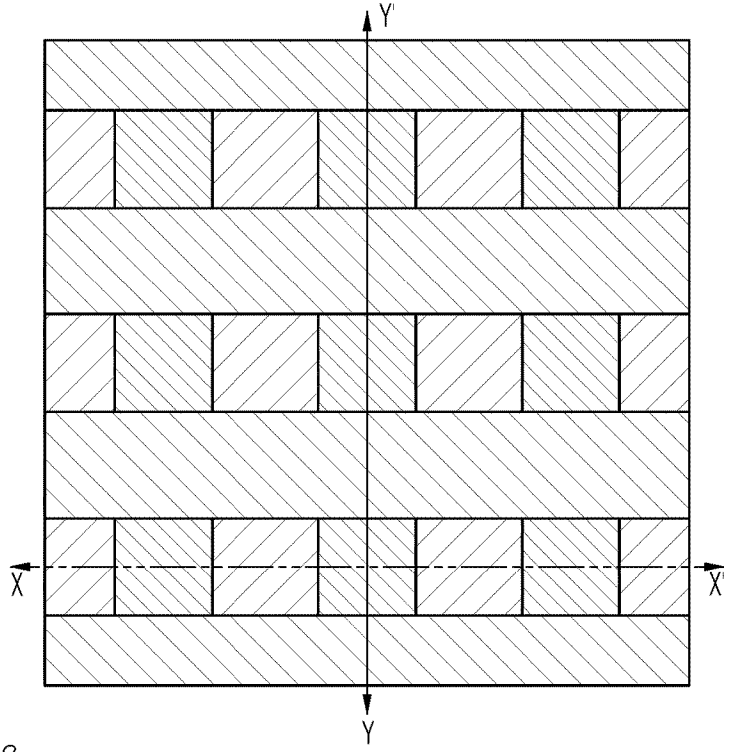
FIG. 4A is a cross-sectional side view of rows of transistors being cut across each gate stack from the top in direction to about line cut using a series of selective single direction reactive-ion etching (REI) step and FIG. 4B is a top view of FIG. 4B.
Figure 4A:
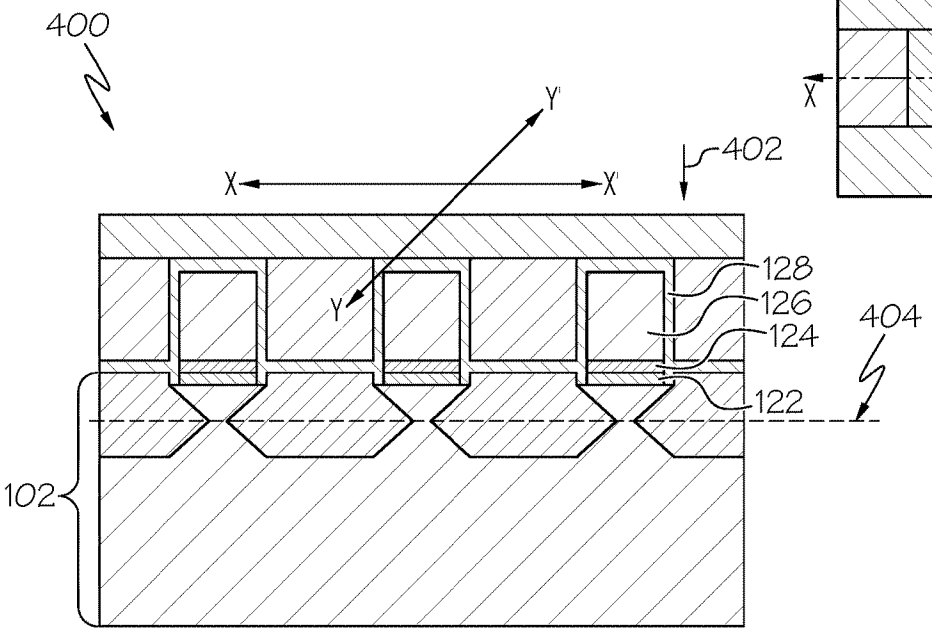

This is the first of two etching steps to open up the middle of the SiGe layer of the source 220 and drain 222. Referring now to FIG. 4A is a cross-sectional view taken along line X-X' of FIG. 4B. FIG. 4A illustrates rows of transistors being cut across each gate stack 220 from the top in direction 402 to about line cut 404 using a series of selective single direction reactive-ion etching (REI) steps of the MOS device 400 above a semiconducting substrate 102. FIG. 4B is a top view of the FIG. 4A. Each layer is from the conformal hard mask liner 302, dielectric material 304, the gate stack 200, to about the lower portion of the source 220 and drain 222 as denoted by cutline 404.

Second Etching Step to Remove Inside Channel Underneath the Gate Stack

This is the second of two etching steps to open up the middle of the SiGe layer of the source 220 and drain 222.

Figure 5B:
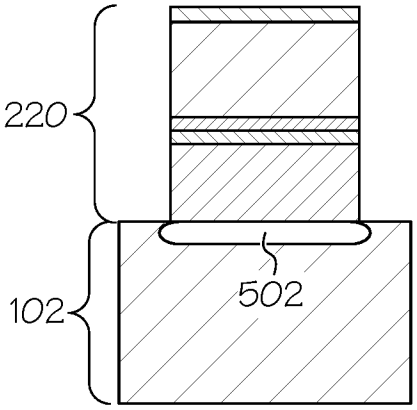
FIG. 5A is a cross-sectional side view of selective removal of the inside of channel to create a void under the gate stack and FIG. 5B is a top view of the FIG. 5A.
Figure 5A:
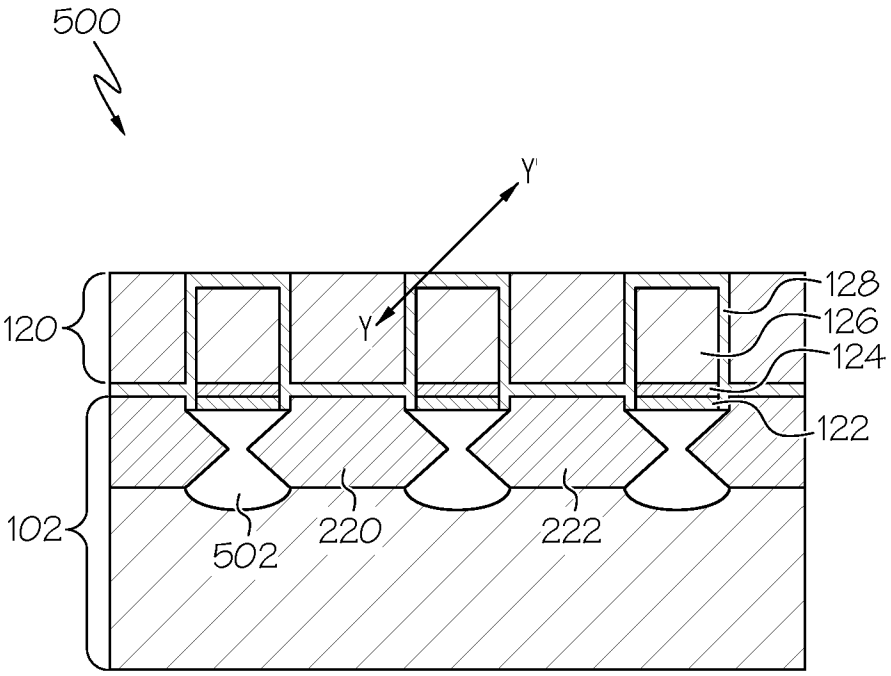

This cut is substantially perpendicular to the first cut of FIG. 4. Referring now to FIG. 5A, shown is selective removal of the inside of channel to create a void 502 under the gate stack 220 as shown of the MOS device 500 above a semiconducting substrate 102. FIG. 5B is a side view of the FIG. 5A taken along line Y-Y'. The typical wet process is used. A first example of a wet process is KOH-based etchant with different concentration and temperature. A second example is chemical etchant composed of hydrofluoric acid, hydrogen peroxide. A third example is acetic acid Formula (HF:H2O2:CH3COOH). 3. solution of NH4OH, H2O2, and H2O).

This second cut using wet etching only etches to the top of the Si highly doped layer 104. There will be some damage to Si (undoped) layer 106 but does not matter since it is just used as substrate.

PVD Spacer Deposition

Figure 6B:
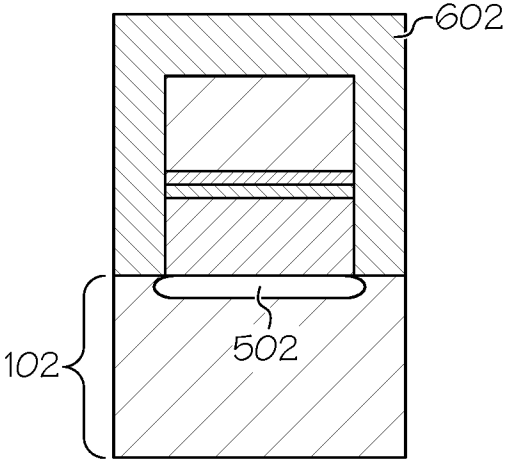
FIG. 6A is a cross-sectional side view of physical vapor deposition (PVD) for another hard mask layer make vacuum inside void of the channel and FIG. 6B is a cross-section view of FIG. 6A taken along line Y-Y'.
Figure 6A:
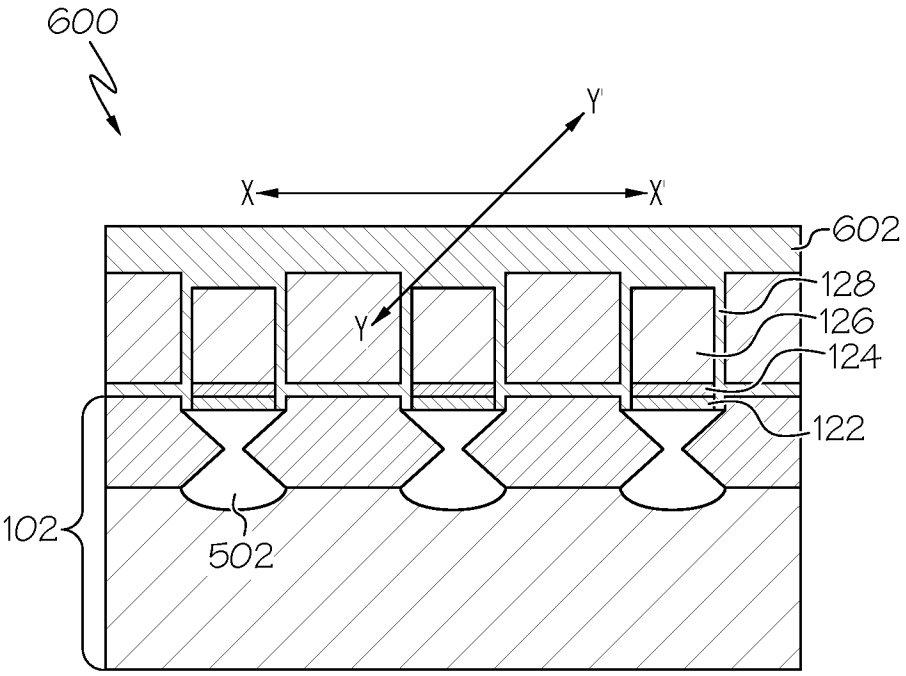

In order to create a vacuum in the void 502, physical vapor deposition (PVD) is used. Referring now to FIG. 6A a PVD for another hard mask layer 602 resulting in a vacuum inside void 502 of the channel of the MOS device 600 above a semiconducting substrate 102. The mask layer can be silicon nitride (SiN) liner to seal void 502. FIG. 6B is a cross-section view of FIG. 6A taken along line Y-Y'.

Contact Formation

Figure 7B:
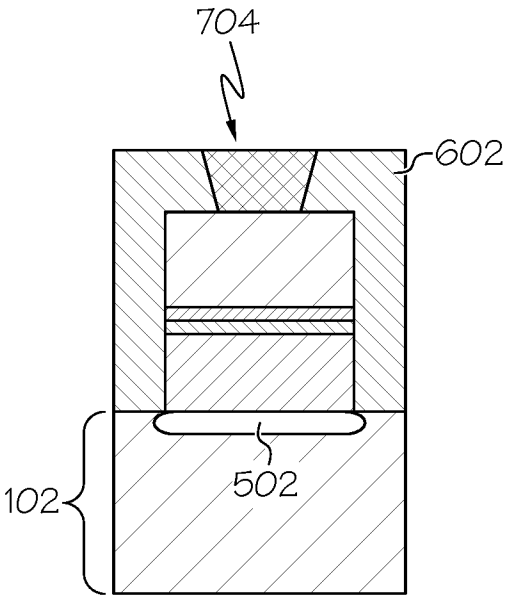
FIG. 7A is a cross-section side view of the formation of contacts and FIG. 7B is a cross-section view of FIG. 7A taken along line Y-Y'.
Figure 7A:
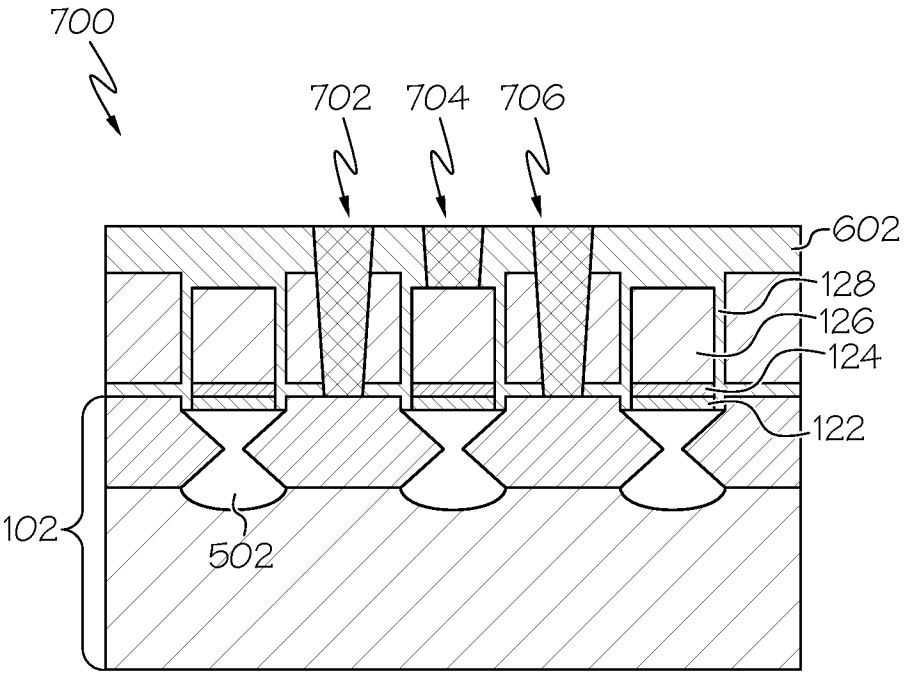

Referring FIG. 7 shown is the formation of contacts of the MOS device 700 above a semiconducting substrate 102. More specifically, shown is after further process steps, which are well known are collector contact 702, gate contact 704, and emitter contact 706. FIG. 7B is a cross-section view of FIG. 7A taken along line Y-Y'.

Figure 8:
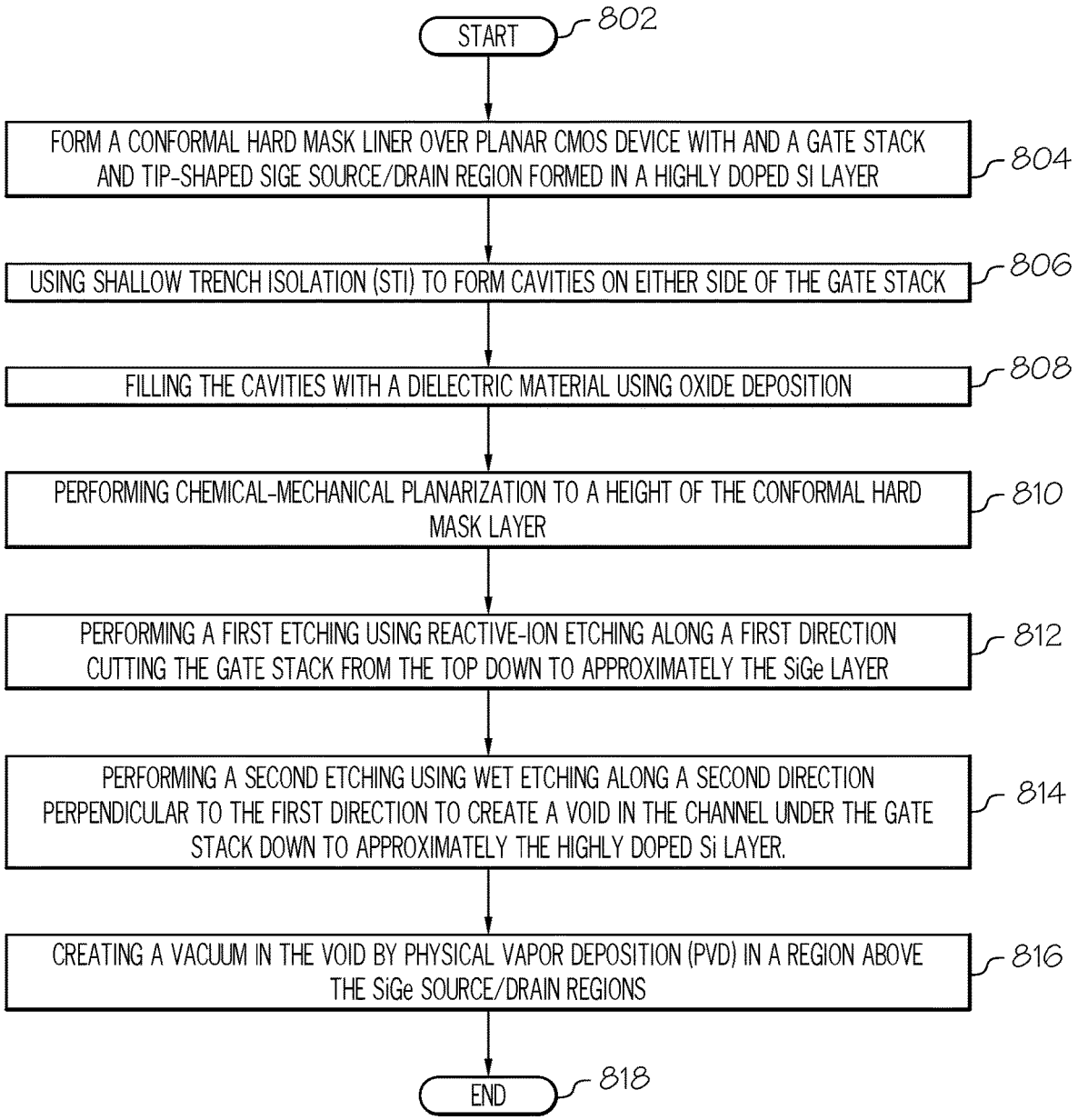
FIG. 8 is an operational flow diagram illustrating one process for forming planar gate-insulated vacuum channel on a highly doped silicon layer semiconductor structure.

Process Flow for Forming Planar Gate-Insulated Vacuum Channel on Highly Doped Layer FIG. 8 is an operational flow diagram illustrating one process for forming planar gate-insulated vacuum channel semiconductor structure. In FIG. 8 the operational flow diagram begins at step 802 and flows directly to step 804. Step 804 is the deposit of a conformal hard mask liner over planar CMOS device with and a gate stack and tip-shaped SiGe source/drain region formed in a highly doped Si layer. Next in step 806, cavities are formed on either side of the gate stack using shallow trench isolation (STI). The cavities are filled, in step 808, with a dielectric material using oxide deposition. This is followed by step 810 in which chemical-mechanical planarization (CMP) is performed to a height of the conformal hard mask layer. Continuing further, step 812, a first etching is performed using reactive-ion etching (RIE) along a first direction cutting the gate stack from the top down to approximately the SiGe layer. Next in step 814, a second etching is performed using wet etching along a second direction perpendicular to the first direction to create a void in the channel under the gate stack down to approximately the highly doped Si layer. Continuing further, in step 816, a vacuum in the void is created by physical vapor deposition (PVDd) in a region above the SiGe source/drain regions. The control flow exits at step 818.

Example 2—SOI

Figure 9B:
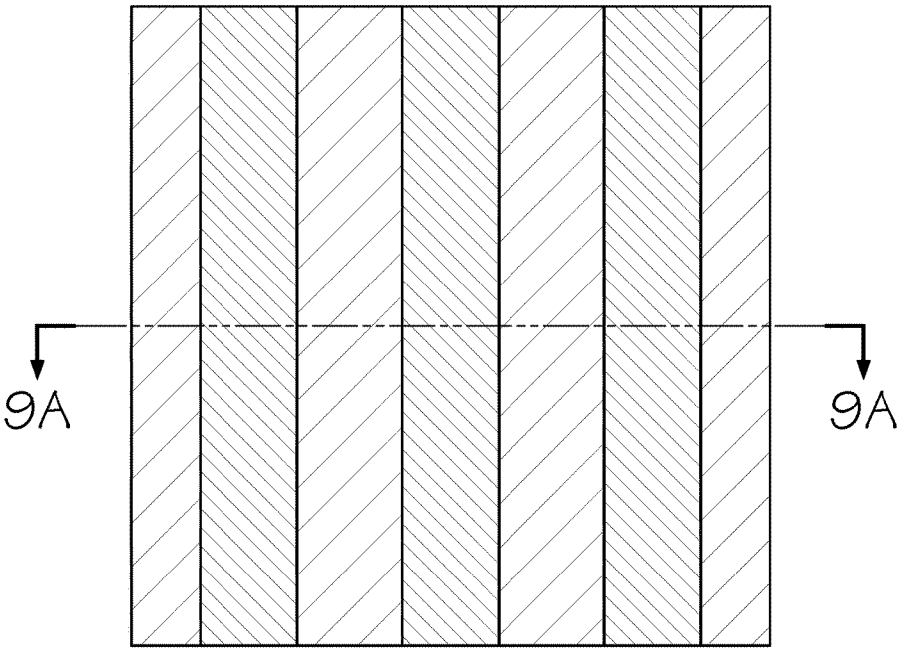
FIG. 9A is a cross-section view of a prior art semiconductor structure resulting from conventional silicon on insulator (SOI) processing and FIG. 9B is a top view of the FIG. 9A.
Figure 9A:
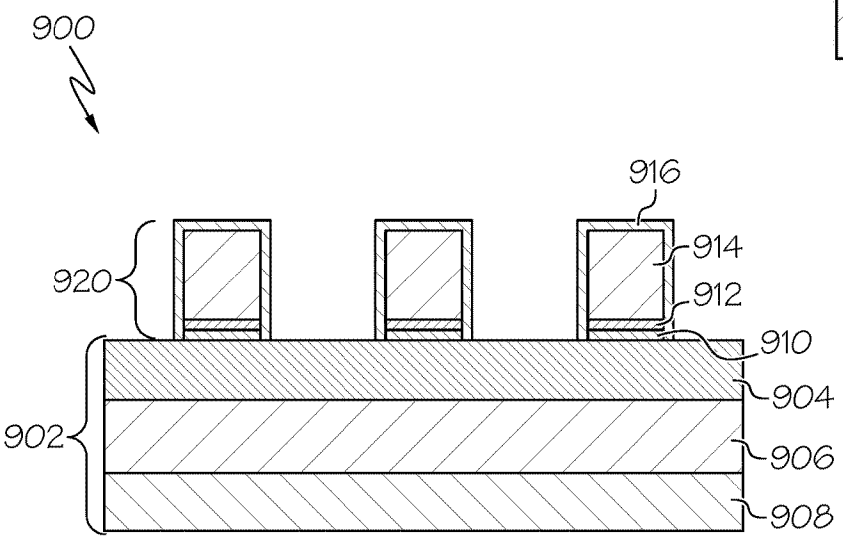

Referring now to FIG. 9A is a cross-sectional view taken along line 9A-9A of FIG. 9B. FIG. 9A is a cross-section view of a prior art semiconductor structure 900 resulting from conventional silicon on insulator (SOI) processing. As shown, in FIG. 9, there is a substrate 902 with a semiconductor layer 908, an SOI structure including a buried oxide BOX region 906 (e.g., an oxide, nitride, oxynitride or any combination thereof, with an oxide such as SiO2 being most typical) that is located between below a top Si-containing layer 904 and a bottom layer 908. Preferably, the BOX region 906 is continuous. The thickness of the BOX region 906 formed in the present invention may vary depending upon the exact embodiments and conditions used in fabricating the same. Typically, however, the BOX region 906 has a thickness from about 200 to about 1800 Å, with a BOX thickness from about 1300 to about 1600 Å being more typical.

After forming the SOI layer 910, pad oxidation and pad nitride layers are deposited and via lithographic techniques, the active areas for respective NFET device and PFET transistor device are defined. That is, a lithographic mask is patterned and formed over the top SOI layer 910 to expose regions for forming shallow trench isolation (STI) structures. This processing includes applying a photoresist to the surface of the SOI substrate 910, exposing the photoresist and developing the exposed photoresist using a conventional resist developer. These STI regions (not shown) can be formed using know techniques to isolate the NFET and PFET devices to be formed.

Continuing, further processing steps are performed for forming the NFET and PFET devices including: preparing a top-contact to back Si substrate formation. This may be achieved, for example, by the following steps: (i) blanket nitride deposition, (ii) lithographically defining contact areas on STI oxide regions, (iii) a thin nitride RIE followed by a deep oxide RIE to create a trench all the way down to the SOI layer 904, (iv) resist strip, (v) thick poly silicon deposition, and (vi) poly silicon CMP that stops on the thin nitride layer, performing an STI deglaze to strip the previously formed pad nitride and pad oxide layers (not shown) [pad nitride is stripped using hot phosphoric acid and then pad oxide is removed using hydrofluoric acid], forming a sacrificial oxidation (sacox) layer to screen well implants for each device, and performing an ion implantation step for forming CMOS wells. The CMOS well implant, which typically forms a well region within the SOI layer 904, is carried out using a conventional ion implantation process well known to those skilled in the art. P- or N-type dopants can be used in forming the well region.

The gate dielectric layers 910 for each of the respective NFET and PFET devices may comprise conventional dielectric materials such as oxides, nitrides and oxynitrides of silicon that have a dielectric constant from about 4 (i.e., typically a silicon oxide) to about 8 (i.e., typically a silicon nitride), measured in vacuum. Alternatively, the gate dielectric 910 may comprise generally higher dielectric constant dielectric materials having a dielectric constant from about 8 to at least about 100. Such higher dielectric constant dielectric materials may include, but are not limited to hafnium oxides, hafnium silicates, zirconium oxides, lanthanum oxides, titanium oxides, barium-strontium-titantates (BSTs) and lead-zirconate-titanates (PZTs). The gate dielectrics 910 for each of the respective NFET and PFET devices may be formed using any of several methods that are appropriate to its material of composition. Non-limiting examples include thermal or plasma oxidation or nitridation methods, chemical vapor deposition methods (including atomic layer deposition methods) and physical vapor deposition methods. Typically, the gate dielectric layers 910 for the gate stack 920 comprise a thermal silicon oxide dielectric material that has a thickness from about 10 to about 30 angstroms. A metal gate 912 is also formed as part of the gate stack 920.

Continuing, there is next formed the gate electrodes 914 for each respective NFET and PFET devices. The gate electrodes 914 may comprise materials including but not limited to certain metals, metal alloys, metal nitrides and metal silicides, as well as laminates thereof and composites thereof. The gate electrodes 914 may also comprise doped polysilicon and polysilicon-germanium alloy materials (i.e., having a dopant concentration from about 1e18 to about 1e22 dopant atoms per cubic centimeter) and polycide materials (doped polysilicon/metal silicide stack materials). Similarly, the foregoing materials may also be formed using any of several methods. Non-limiting examples include salicide methods, chemical vapor deposition methods and physical vapor deposition methods, such as, but not limited to evaporative methods and sputtering methods. Typically, the gate electrodes 914 each comprise a doped polysilicon material that has a thickness from about 500 to about 1500 angstroms. The NFET gate polysilicon is then doped with n-type dopants (As or P or Sb) and the PFET gate polysilicon with p-type dopants (B or BF2 or In). Selective doping is achieved using photolithography to cover one type of FETs while exposing the other to ion implants.

In a further processing step, capping layers 916 for respective gate stack 920 are formed that comprises a capping material that in turn typically comprises a hard mask material. This hard mask material is required for selective Si or SiGe epitaxy that is performed later. Without the hard mask, Si or SiGe also gets deposited on the gate polysilicon and causes a gate mushroom that could come in physical contact with the raised source/drain, thereby, causing gate-to-source and/or gate-to-drain shorts. Dielectric hard mask materials are most common but by no means limit the instant embodiment or the invention. Non-limiting examples of hard mask materials include oxides, nitrides and oxynitrides of silicon. Oxides, nitrides and oxynitrides of other elements are not excluded. The capping material may be formed using any of several methods that are conventional in the semiconductor fabrication art. Non-limiting examples include chemical vapor deposition methods and physical vapor deposition methods. Preferably, a silicon nitride (SiN) and high-temperature oxide (HTO) hard mask deposition is performed to cap the gate polysilicon for raised source/drain (RSD) integration. Using typical gate lithography and etch techniques, the gate stack 920 result having a respective SiN cap 916 formed on top. The SiN capping layers 916 have a thickness from about 100 to about 500 angstroms.

Insofar as the top Si-containing layer 904 of the SOI substrate 902 is concerned, that Si-containing layer may have a variable thickness, which is also dependent on the embodiment and conditions used in fabricating the SOI substrate. Typically, however, the top Si-containing layer 904 of the SOI substrate 902 has a thickness from about 10 to about 1000 Å, with a top Si-containing layer thickness from about 200 to about 700 Å being more typical. According to the invention, the SOI layer 902 is of a thickness ranging between 10 and 300 Å. The thickness of the bottom Si-containing layer 908 of the SOI substrate 902 is inconsequential to the present invention.

The substrate 902 of the present invention can be used in forming high-performance semiconductor devices or circuits. Examples of such devices or circuits that can contain the SOI substrate of the present invention include, but are not limited to: microprocessors, memory cells such as dynamic random access memory (DRAM) or static random access memory (SRAM), application specific integrated circuits (ASICs), optical electronic circuits, and larger and more complicated circuits. Since these devices or circuits are well known to those skilled in the art, it is not necessary to provide a detail description concerning the same herein. It is however emphasized that the active devices and/or circuits of such semiconductor devices and circuits are typically formed in the top Si-containing layer of the substrate 902. The invention is described hereinafter with respect to forming NFET and PFET formed in the top Si-containing layer of the SOI substrate 904.

The term "Si-containing" when used in conjunction with layers 908 and 904 denotes any semiconductor material that includes silicon therein. Illustrative examples of such Si-containing materials include but are not limited to: Si, SiGe, SiGeC, SiC, Si/Si, Si/SiGe, preformed SOI wafers, silicon germanium-on-insulators (SGOI) and other like semiconductor materials. The preformed SOI wafers and SGOI wafers, which can be patterned or unpatterned, may also include a single or multiple buried oxide regions formed therein. The Si-containing material can be undoped or doped (p or n-doped) depending on the future use of the SOI substrate.

SOI Recess and Epitaxy

Figure 10B:
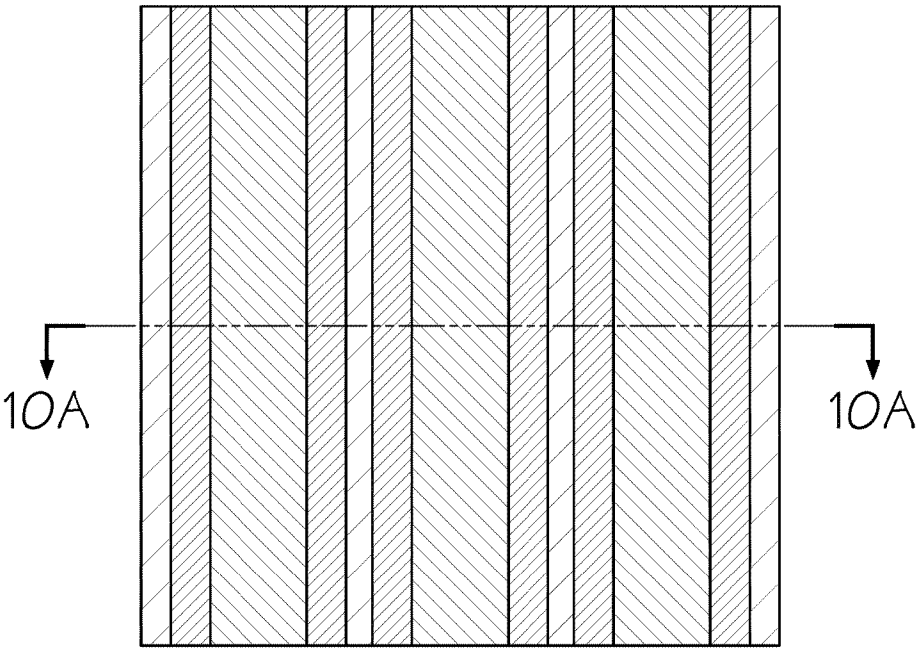
FIG. 10A is a cross-section view of a SOI layer recess using selective epitaxy and FIG. 10B is a top view of the FIG. 10A.
Figure 10A:
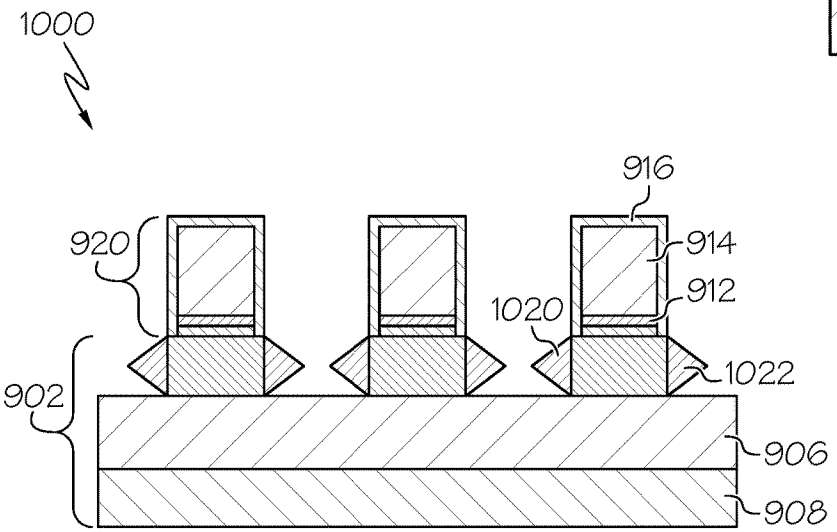

As part of the conventional SOI processing, the SOI layer 910 may be thinned using oxidation and wet etch techniques. Referring now to FIG. 10A is a cross-sectional view taken along line 10A-10A of FIG. 10B. FIG. 10A illustrates a SOI layer recess using selective epitaxy of the structure 1000 on the SOI substrate 902. After forming the SOI layer 910, very thin pad oxidation and pad nitride layers are deposited and via lithographic techniques, the active areas 1020, 1022 for respective NFET device and PFET transistor device are defined. That is, a lithographic mask is patterned and formed over the top SOI layer 910 to expose regions for forming shallow trench isolation (STI) structures. This processing includes applying a photoresist to the surface of the SOI substrate 910, exposing the photoresist and developing the exposed photoresist using a conventional resist developer. The etching step used in forming the STI trenches includes any standard Si directional reactive ion etch process. Other dry etching processes such as plasma etching, ion beam etching and laser ablation, are also contemplated herein. The etch can be stopped on the top of the thick BOX layer 906 with no more than 50 Å BOX loss.

SiN Liner and STI Oxide Deposition

Figure 11B:
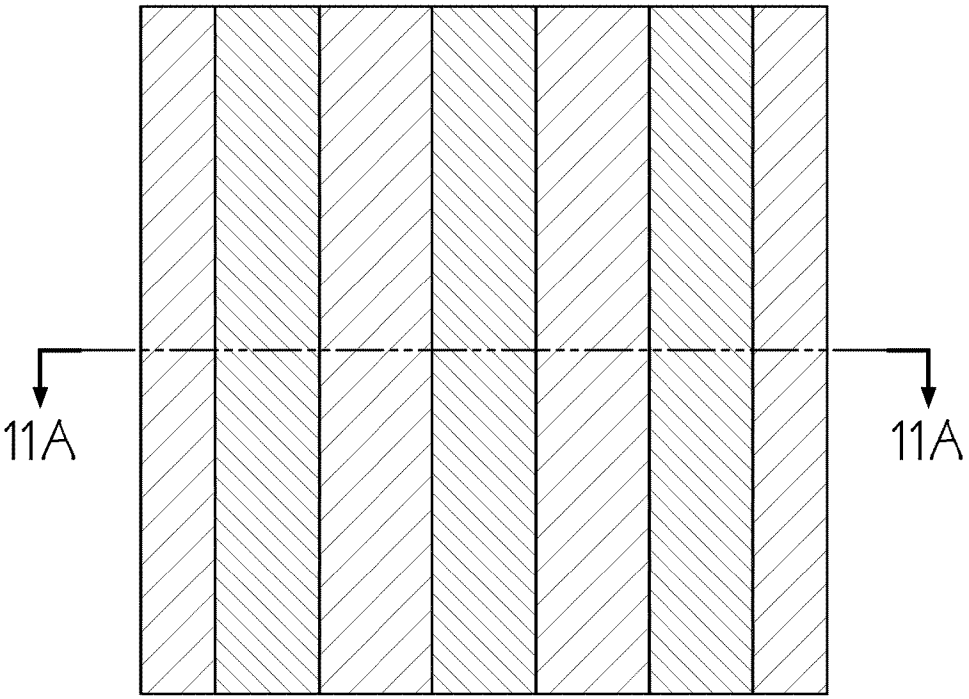
FIG. 11A is a cross-sectional view of a deposit of a conformal hard mask liner and FIG. 11B is a top view of the FIG. 11A.
Figure 11A:
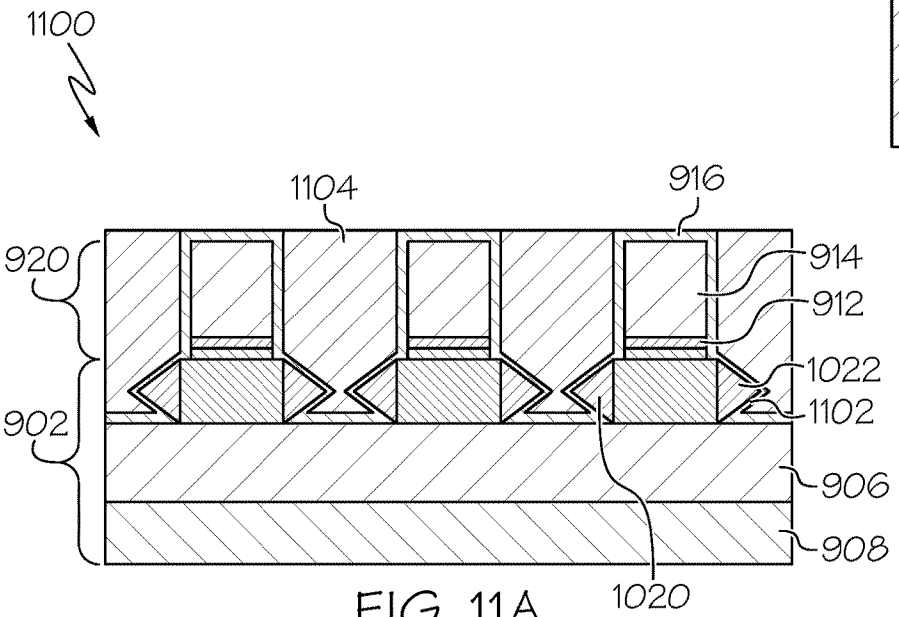

Referring now to FIG. 11A is a cross-sectional view taken along line 11A-11A of FIG. 11B. Referring now to FIG. 11A, shown is a deposit of a conformal hard mask liner 1102, such as silicon nitride (SiN) liner, over the gate stack 1020 and the SiGe source 1020/drain 1022 regions of the structure 1100 on the SOI substrate 902. FIG. 11B is a top view of the FIG. 11A. Following the liner 1102 is shallow trench isolation (STI) 1104 filing the resulting trenches with a dielectric material 1104, such as, silicon dioxide ($SiO_2$). The STI step is typically followed by a chemical-mechanical planarization (CMP) process resulting in the structure 1100 as shown to the height of the liner 1102.

First Etching Steps to Cut the Gate

This is the first of two etching steps to open up the middle of the SiGe layer of the source 1020 and drain 1022.

Figure 12B:
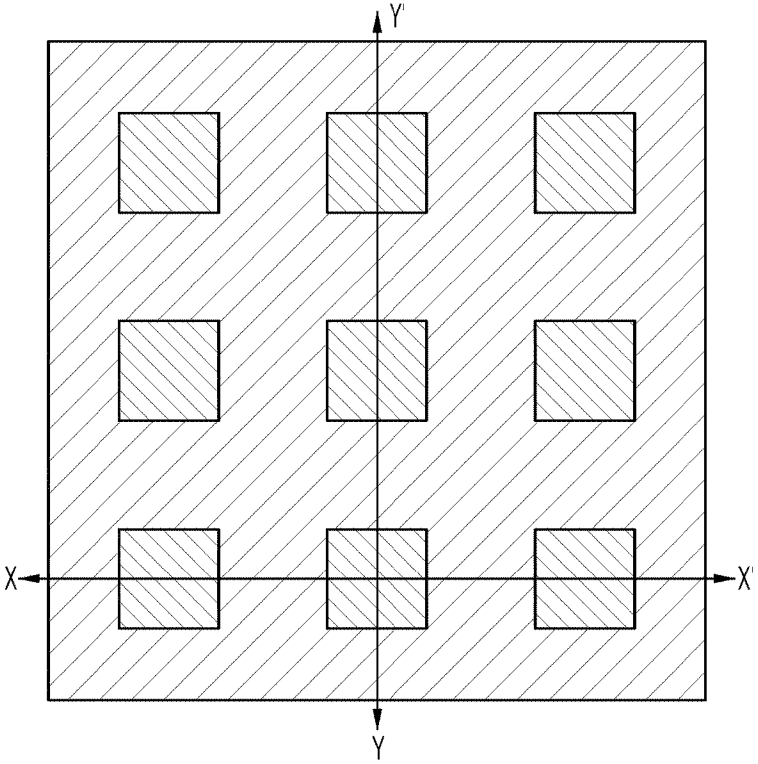
FIG. 12A is a cross-sectional view of rows of transistors being cut across each gate stack from the top in direction to about line cut using selective single direction reactive-ion etching and FIG. 12B is a top view of FIG. 12A.
Figure 12A:
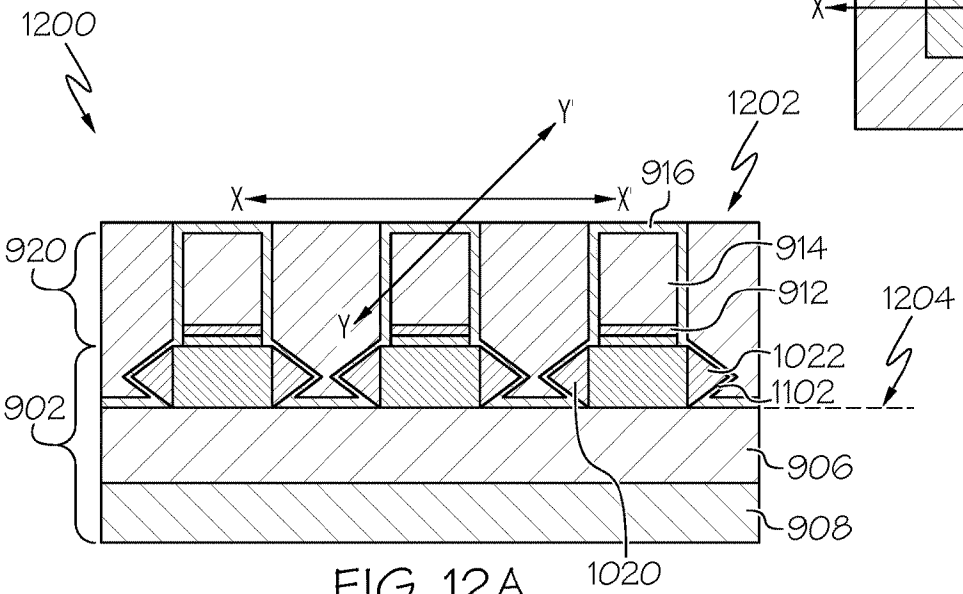

Referring now to FIG. 12A is a cross-sectional view taken along line X-X of FIG. 12B. The rows of transistors 1200 being cut across each gate stack 1020 from the top in direction 1202 to about line cut 1104 using a series of selective single direction reactive-ion etching (REI) steps. Each layer is from the conformal hard mask liner 1102, dielectric material 910, the gate stack 1002, to about the lower portion of the source 1020 and drain 1022 as denoted by cutline 1204.

Second Etching Step to Remove Inside Channel Underneath the Gate

Figure 13B:
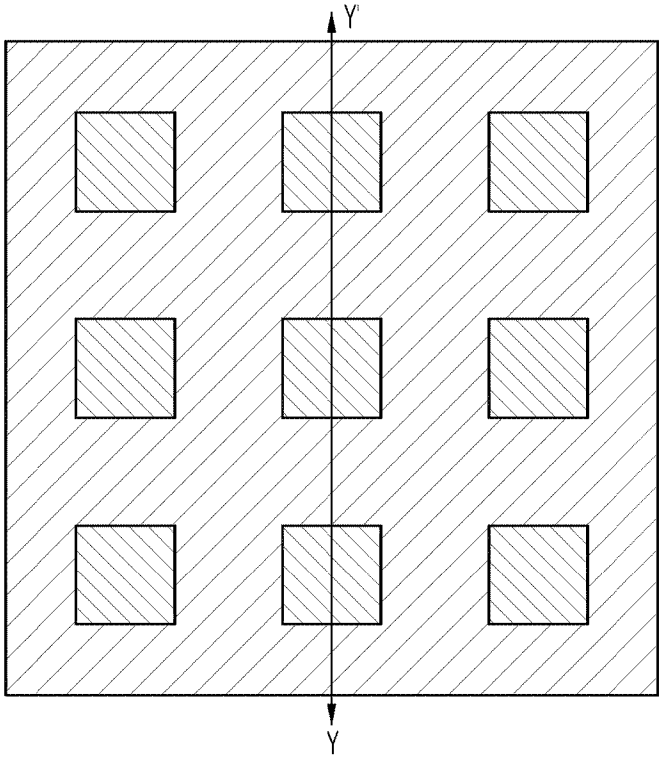
FIG. 13A is a cross-section view of selective removal of the inside of channel to create a void and FIG. 13B is a top view of the FIG. 13A.
Figure 13A:
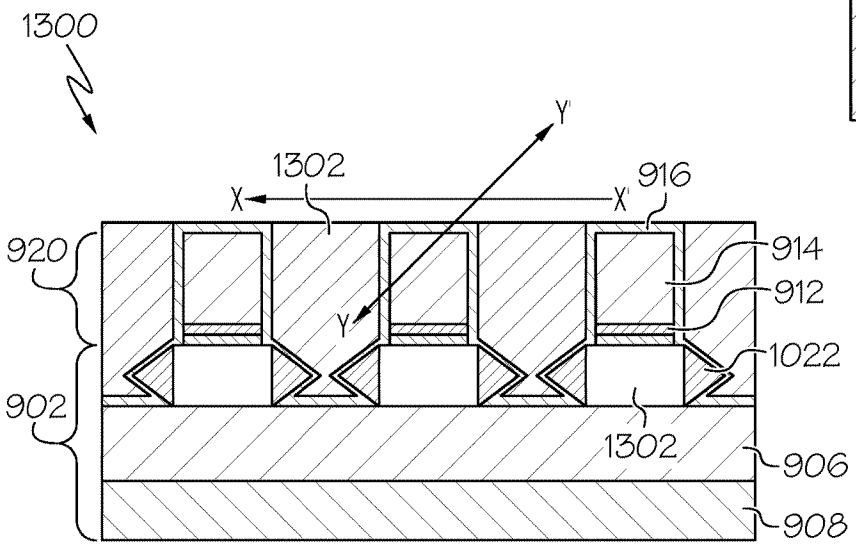

This is the second of two etching steps to open up the middle of the SiGe layer of the source 1020 and drain 1022. Referring now to FIG. 13A is a cross-sectional view taken along line Y-Y of FIG. 13B. This cut is substantially perpendicular to the first cut of FIG. 12. Referring now to FIG. 13A shown is selective removal of the inside of channel to create a void 1302 under the gate stack 920 as shown of the structure 1300 on the SOI substrate 902.

The typical wet process used is used. A first example of a wet process is KOH-based etchant with different concentration and temperature. A second example is chemical etchant composed of hydrofluoric acid, hydrogen peroxide. A third example is acetic acid Formula (HF:H2O2: CH3COOH). 3. solution of NH4OH, H2O2, and H2O).

This second cut using wet etching only etches to the top of the SOI layer 904. There will be some damage to the box layer 906 but does not matter since it is just used as substrate.

Si Epitaxy

Figure 14B:
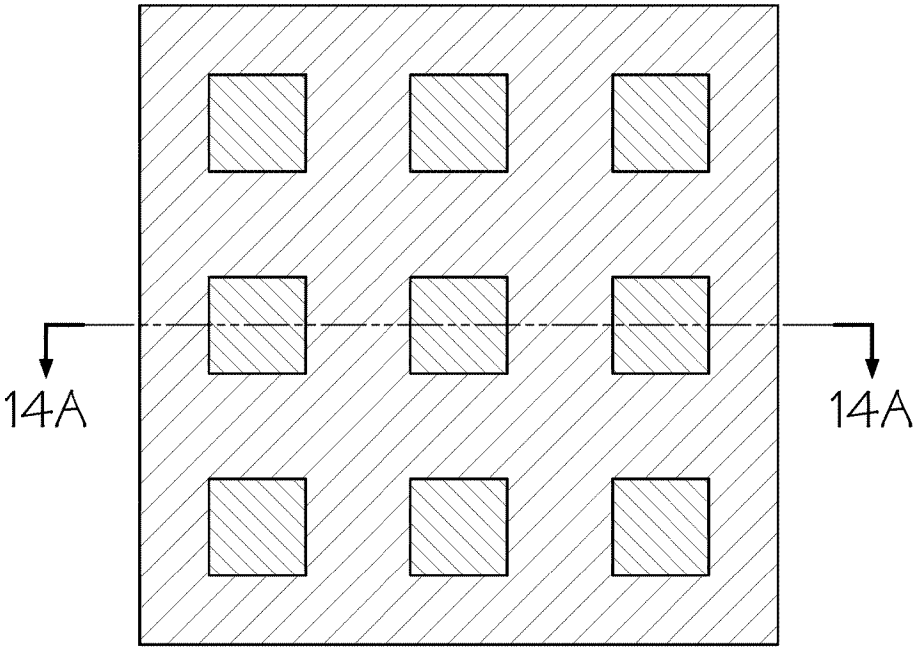
FIG. 14A is a cross-section view of selective Si or SiGe epitaxy performed over the hard mask and FIG. 14B is a top view of the FIG. 14A.
Figure 14A:
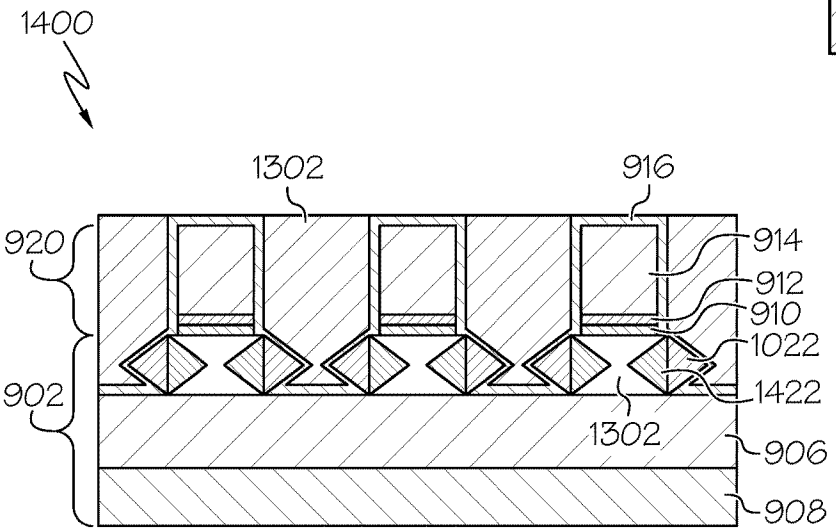

Referring now to FIG. 14A selective Si or SiGe epitaxy is performed over the hard mask 1002 of the structure 1400 on the SOI substrate 902. Shown is SiGE growing inside the void 1202.

PVD Spacer Fill

Figure 15B:
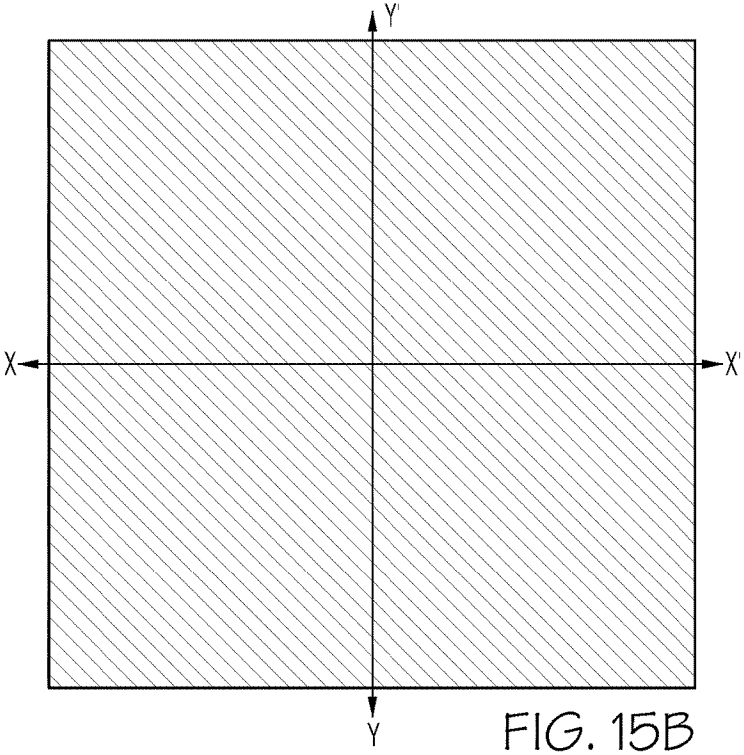
FIG. 15B is a cross-section view of FIG. 15A taken along line Y-Y' and FIG. 15C is a cross-section view of FIG. 15A taken along line X-X'.
Figure 15C:
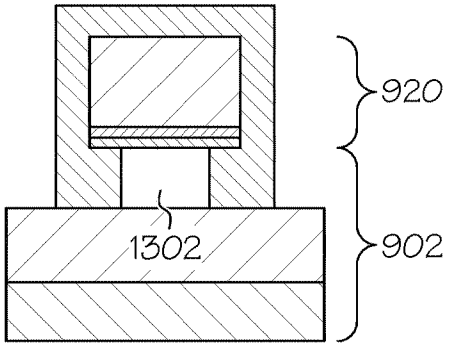
Figure 15A:
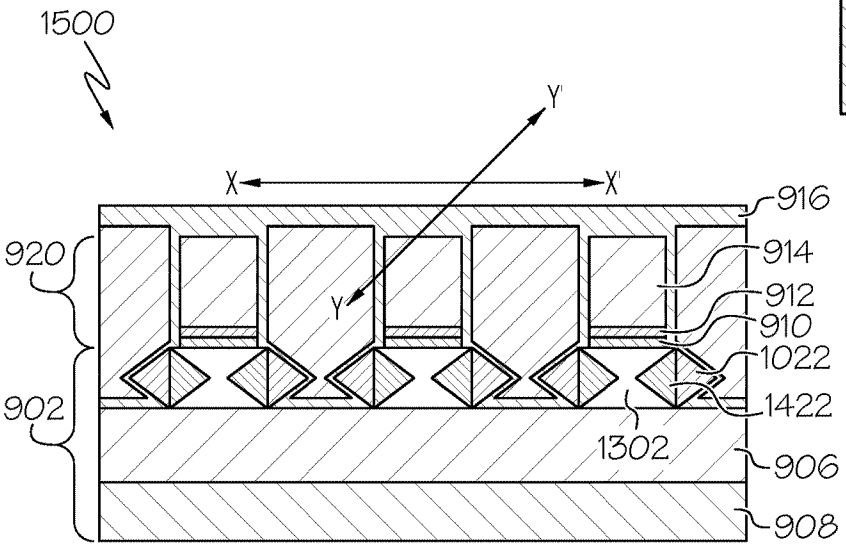
FIG. 15A is a cross-section view of a physical vapor deposition (PVD) of another hard mask layer forming a vacuum inside void.

Referring now to FIG. 15A is a cross-sectional view taken along line 15A-15A of FIG. 15B. FIG. 15C is a side view taken along Y-Y' of FIG. 15A. FIG. 15A illustrates a physical vapor deposition (PVD) of another hard mask layer forming a vacuum inside void 1302 of the channel of the structure 1500 on the SOI substrate 902. The mask layer can be silicon nitride (SiN) liner to seal void 1302.

Contact Formation

Figure 16B:
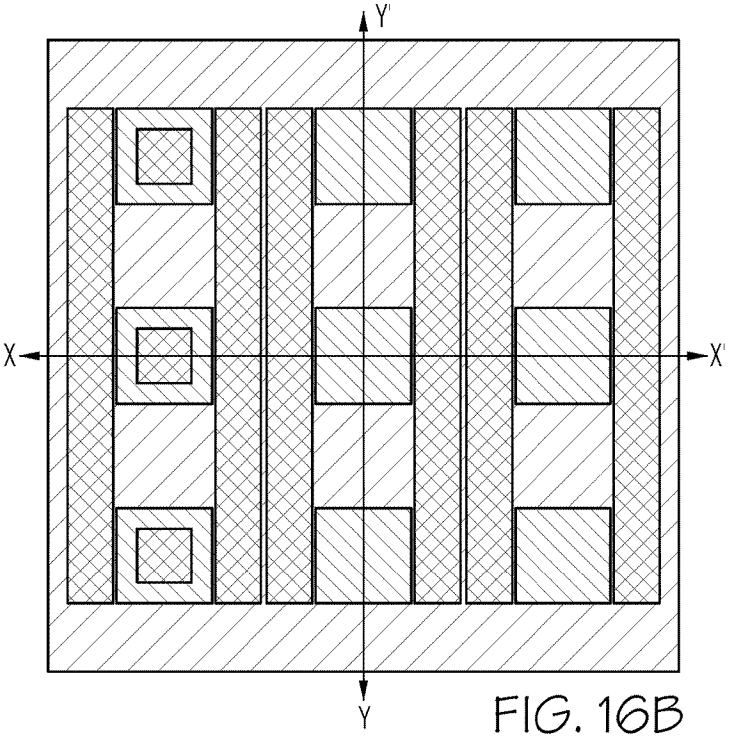
FIG. 16A shown is a cross-section view of the formation of contacts and FIG. 16B is a cross-section view of FIG. 16A taken along line Y-Y' and FIG. 16C is a cross-section view of FIG. 16A taken along line X-X'.
Figure 16C:
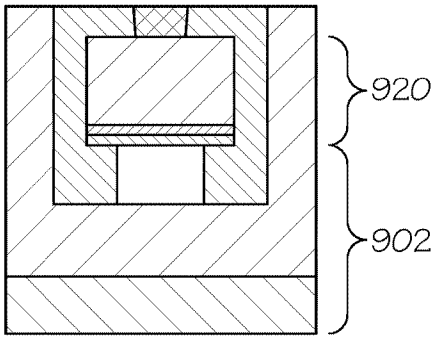
Figure 16A:
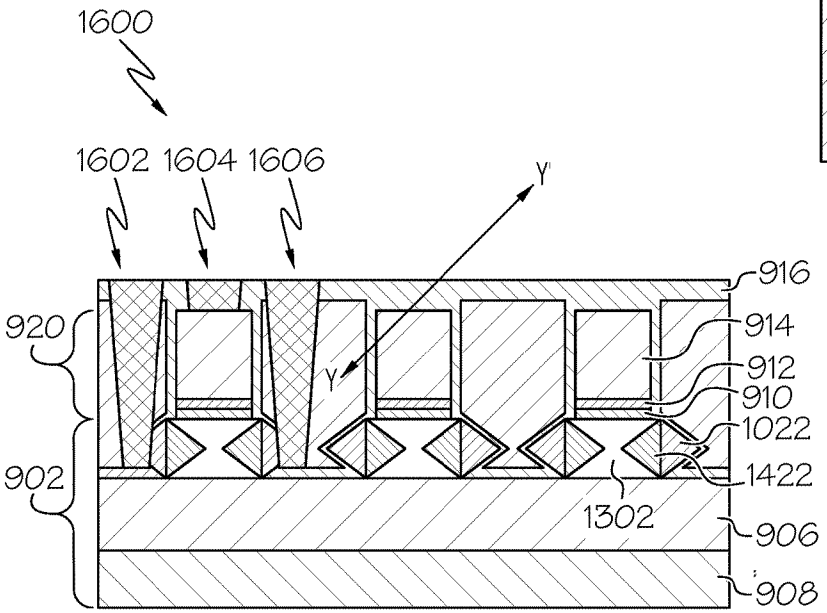

Turning now to FIG. 16A is a cross-sectional view taken along line 16A-16A of FIG. 16B. FIG. 16C is a side view taken along Y-Y' of FIG. 16A. FIG. 16A shows the formation of contacts of the structure 1600 on the SOI substrate 902. More specifically, shown is after further process steps, which are well known are collector contact 1602, gate contact 1604, and emitter contact 1606.

Process Flow for Forming Planar Gate-Insulated Vacuum Channel on SOI Layer

Figure 17:
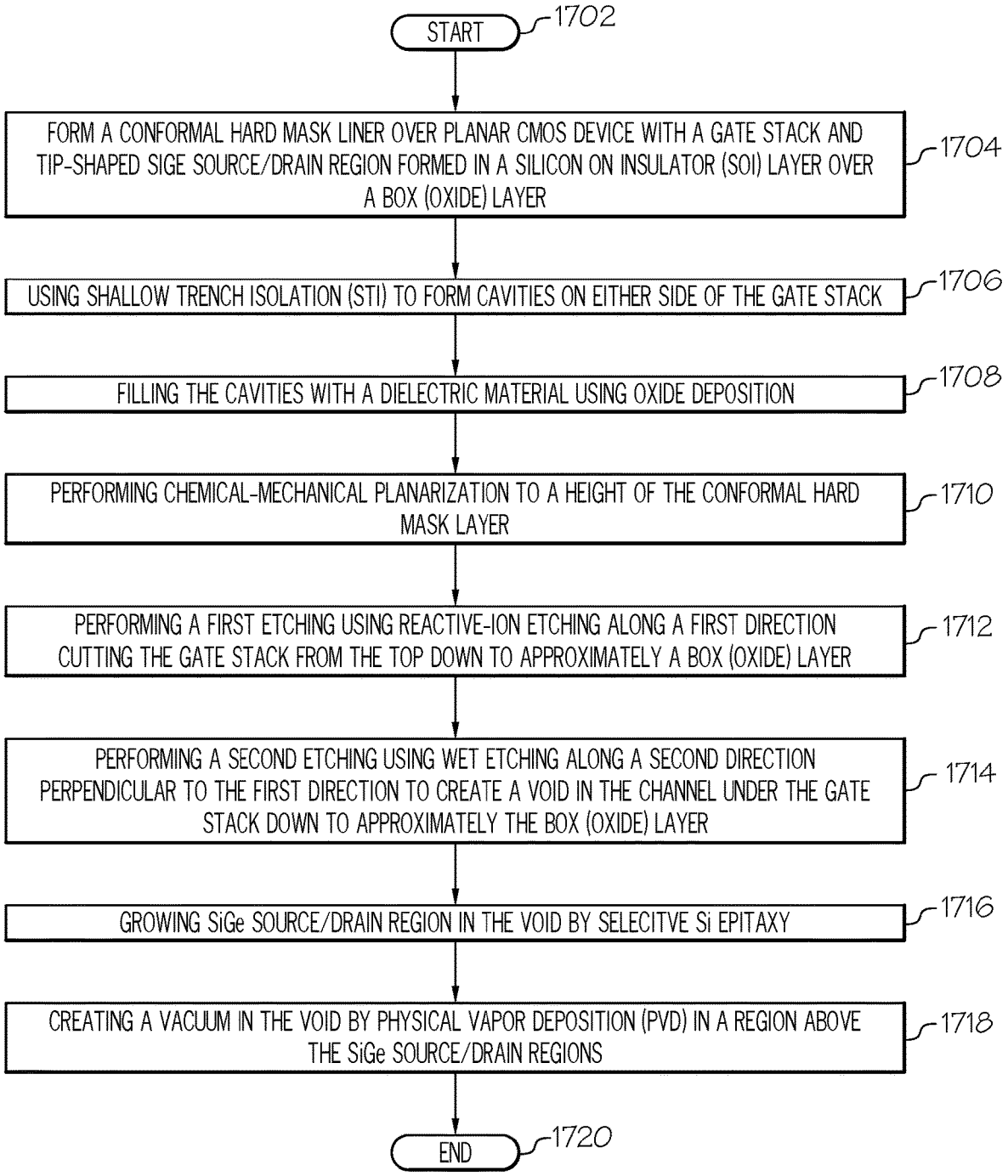
FIG. 17 is an operational flow diagram illustrating one process for forming planar gate-insulated vacuum channel on a silicon on insulator SOI semiconductor structure.

FIG. 17 is an operational flow diagram illustrating one process for forming a planar gate-insulated vacuum channel semiconductor structure. In FIG. 17, the operational flow diagram begins at step 1702 and flows directly to step 1704. Step 1704 is the formation of a conformal hard mask liner over planar CMOS device with and a gate stack and tip-shaped SiGe source/drain region formed in a Silicon on Insulator (SOI) layer over a box oxide. Next in step 1706, cavities are formed on either side of the gate stack using shallow trench isolation (STI). The cavities are filled, in step 1708, with a dielectric material using oxide deposition. This is followed by step 1710 in which chemical-mechanical planarization (CMP) is performed to a height of the conformal hard mask layer. Continuing further, step 1712, a first etching is performed using reactive-ion etching (RIE) along a first direction cutting the gate stack from the top down to approximately the box oxide layer. Next in step 1714, a second etching is performed using wet etching along a second direction perpendicular to the first direction to create a void in the channel under the gate stack down to approximately the box oxide layer. In step 1716, the SiGe source/drain region is grown in the void by selective Si epitaxy. Continuing still further, in step 1718 a vacuum in the void is created by physical vapor deposition (PVD) in a region above the SiGe source/drain regions. The control flow exits at step 1720.

Design Process Flow

Figure 18:
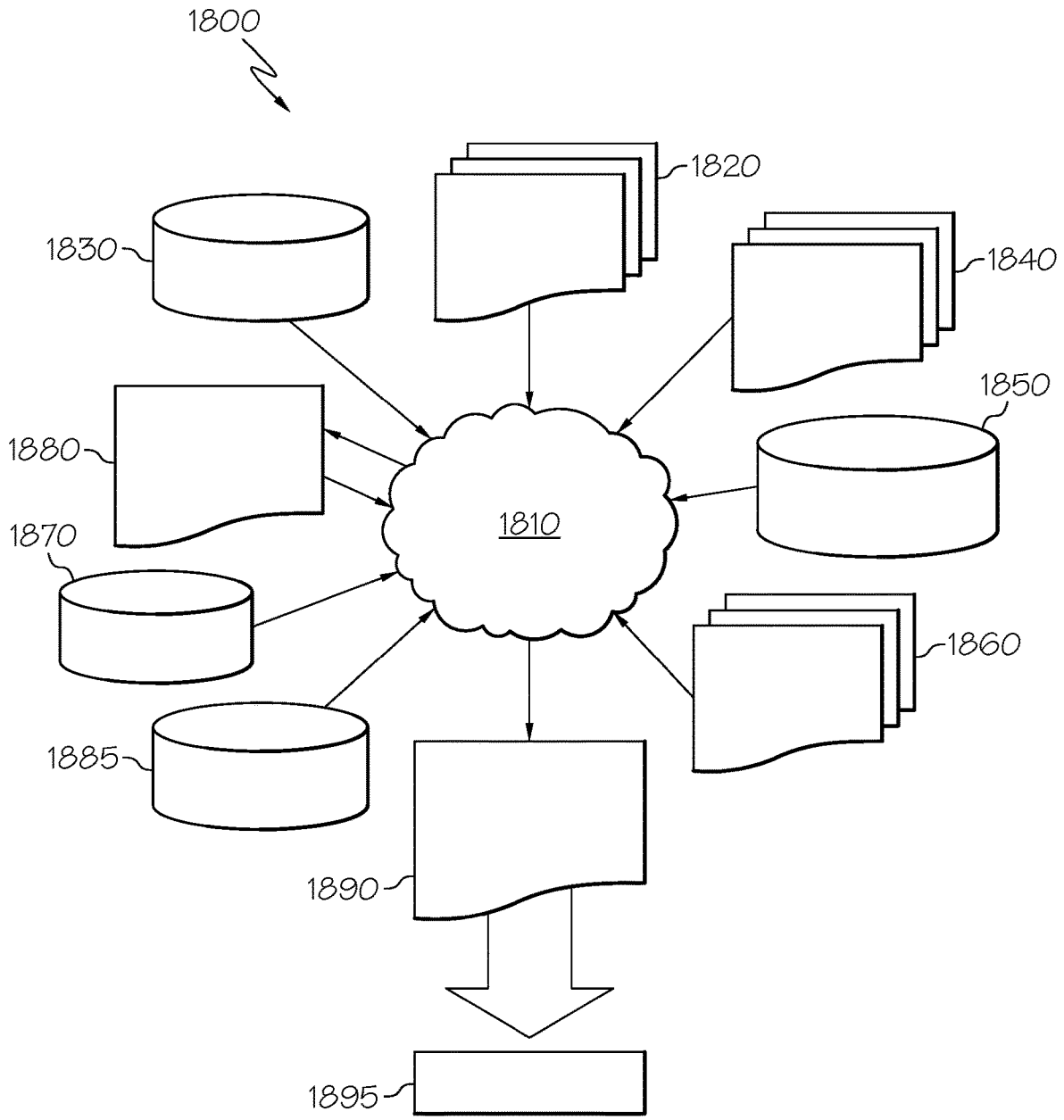
FIG. 18 is an operational flow diagram illustrating one process for forming a semiconductor structure according one embodiment of the present disclosure.

FIG. 18 shows a block diagram of an exemplary design flow 1800 used for example, in semiconductor IC logic design, simulation, test, layout, and manufacture. Design flow 1800 includes processes, machines, and/or mechanisms for processing design structures or devices to generate logically or otherwise functionally equivalent representations of the design structures and/or devices described above and shown in FIGS. 1-17. The design structures processed and/or generated by design flow 1800 may be encoded on machine-readable transmission or storage media to include data and/or instructions that when executed or otherwise processed on a data processing system generate a logically, structurally, mechanically, or otherwise functionally equivalent representation of hardware components, circuits, devices, or systems. Machines include, but are not limited to, any machine used in an IC design process, such as designing, manufacturing, or simulating a circuit, component, device, or system. For example, machines may include: lithography machines, machines and/or equipment for generating masks (e.g. e-beam writers), computers or equipment for simulating design structures, any apparatus used in the manufacturing or test process, or any machines for programming functionally equivalent representations of the design structures into any medium (e.g. a machine for programming a programmable gate array).

Design flow 1800 may vary depending on the type of representation being designed. For example, a design flow 1800 for building an application specific IC (ASIC) may differ from a design flow 1800 for designing a standard component or from a design flow 1800 for instantiating the design into a programmable array, for example a programmable gate array (PGA) or a field programmable gate array (FPGA) offered by Altera® Inc. or Xilinx® Inc.

FIG. 18 illustrates multiple such design structures including an input design structure 1820 that is preferably processed by a design process 1810. Design structure 1820 may be a logical simulation design structure generated and processed by design process 1810 to produce a logically equivalent functional representation of a hardware device. Design structure 1820 may also or alternatively comprise data and/or program instructions that when processed by design process 1810, generate a functional representation of the physical structure of a hardware device. Whether representing functional and/or structural design features, design structure 1820 may be generated using electronic computer-aided design (ECAD) such as implemented by a core developer/designer. When encoded on a machine-readable data transmission, gate array, or storage medium, design structure 1820 may be accessed and processed by one or more hardware and/or software modules within design process 1810 to simulate or otherwise functionally represent an electronic component, circuit, electronic or logic module, apparatus, device, or system such as those shown in FIGS. 1-17. As such, design structure 1820 may comprise files or other data structures including human and/or machine-readable source code, compiled structures, and computer-executable code structures that when processed by a design or simulation data processing system, functionally simulate or otherwise represent circuits or other levels of hardware logic design. Such data structures may include hardware-description language (HDL) design entities or other data structures conforming to and/or compatible with lower-level HDL design languages such as Verilog and VHDL, and/or higher level design languages such as C or C++.

Design process 1810 preferably employs and incorporates hardware and/or software modules for synthesizing, translating, or otherwise processing a design/simulation functional equivalent of the components, circuits, devices, or logic structures shown in FIGS. 1-18 to generate a Netlist 1880 which may contain design structures such as design structure 1820. Netlist 1880 may comprise, for example, compiled or otherwise processed data structures representing a list of wires, discrete components, logic gates, control circuits, I/O devices, models, etc. that describes the connections to other elements and circuits in an integrated circuit design. Netlist 1880 may be synthesized using an iterative process in which netlist 1880 is resynthesized one or more times depending on design specifications and parameters for the device. As with other design structure types described herein, netlist 1880 may be recorded on a machine-readable data storage medium or programmed into a programmable gate array. The medium may be a non-volatile storage medium such as a magnetic or optical disk drive, a programmable gate array, a compact flash, or other flash memory. Additionally, or in the alternative, the medium may be a system or cache memory, buffer space, or electrically or optically conductive devices and materials on which data packets may be transmitted and intermediately stored via the Internet, or other networking suitable means.

Design process 1810 may include hardware and software modules for processing a variety of input data structure types including Netlist 1880. Such data structure types may reside, for example, within library elements 1830 and include a set of commonly used elements, circuits, and devices, including models, layouts, and symbolic representations, for a given manufacturing technology (e.g., different technology nodes, 32 nm, 45 nm, 90 nm, etc.). The data structure types may further include design specifications 1840, characterization data 1850, verification data 1860, design rules 1870, and test data files 1885 which may include input test patterns, output test results, and other testing information. Design process 1810 may further include, for example, standard mechanical design processes such as stress analysis, thermal analysis, mechanical event simulation, process simulation for operations such as casting, molding, and die press forming, etc. One of ordinary skill in the art of mechanical design can appreciate the extent of possible mechanical design tools and applications used in design process 1810 without deviating from the scope and spirit of the invention. Design process 1810 may also include modules for performing standard circuit design processes such as timing analysis, verification, design rule checking, place and route operations, etc.

Design process 1810 employs and incorporates logic and physical design tools such as HDL compilers and simulation model build tools to process design structure 1820 together with some or all of the depicted supporting data structures along with any additional mechanical design or data (if applicable), to generate a second design structure 1890. Design structure 1890 resides on a storage medium or programmable gate array in a data format used for the exchange of data of mechanical devices and structures (e.g. information stored in a IGES, DXF, Parasolid XT, JT, DRG, or any other suitable format for storing or rendering such mechanical design structures). Similar to design structure 1820, design structure 1890 preferably comprises one or more files, data structures, or other computer-encoded data or instructions that reside on transmission or data storage media and that when processed by an ECAD system generate a logically or otherwise functionally equivalent form of one or more of the embodiments of the invention shown in FIGS. 1-18. In one embodiment, design structure 1890 may comprise a compiled, executable HDL simulation model that functionally simulates the devices shown in FIGS. 1-17.

Design structure 1890 may also employ a data format used for the exchange of layout data of integrated circuits and/or symbolic data format (e.g. information stored in a GDSII (GDS2), GL1, OASIS, map files, or any other suitable format for storing such design data structures). Design structure 1890 may comprise information such as, for example, symbolic data, map files, test data files, design content files, manufacturing data, layout parameters, wires, levels of metal, vias, shapes, data for routing through the manufacturing line, and any other data required by a manufacturer or other designer/developer to produce a device or structure as described above and shown in FIGS. 1-17. Design structure 1890 may then proceed to a stage 1895 where, for example, design structure 1890: proceeds to tape-out, is released to manufacturing, is released to a mask house, is sent to another design house, is sent back to the customer, etc.

The method as described above is used in the fabrication of integrated circuit chips.

The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Java, Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

Integrated Circuit

The present embodiments may include a design for an integrated circuit chip, which may be created in a graphical computer programming language, and stored in a computer storage medium (such as a disk, tape, physical hard drive, or virtual hard drive such as in a storage access network). If the designer does not fabricate chips or the photolithographic masks used to fabricate chips, the designer may transmit the resulting design by physical means (e.g., by providing a copy of the storage medium storing the design) or electronically (e.g., through the Internet) to such entities, directly or indirectly. The stored design is then converted into the appropriate format (e.g., GDSII) for the fabrication of photolithographic masks, which typically include multiple copies of the chip design in question that are to be formed on a wafer. The photolithographic masks are utilized to define areas of the wafer (and/or the layers thereon) to be etched or otherwise processed.

Methods as described herein may be used in the fabrication of integrated circuit chips. The resulting integrated circuit chips can be distributed by the fabricator in raw wafer form (that is, as a single wafer that has multiple unpackaged chips), as a bare die, or in a packaged form. In the latter case the chip is mounted in a single chip package (such as a plastic carrier, with leads that are affixed to a motherboard or other higher level carrier) or in a multichip package (such as a ceramic carrier that has either or both surface interconnections or buried interconnections). In any case the chip is then integrated with other chips, discrete circuit elements, and/or other signal processing devices as part of either (a) an intermediate product, such as a motherboard, or (b) an end product. The end product can be any product that includes integrated circuit chips, ranging from toys and other low-end applications to advanced computer products having a display, a keyboard or other input device, and a central processor.

Reference in the specification to "one embodiment" or "an embodiment" of the present principles, as well as other variations thereof, means that a particular feature, structure, characteristic, and so forth described in connection with the embodiment is included in at least one embodiment of the present principles. Thus, the appearances of the phrase "in one embodiment" or "in an embodiment", as well any other variations, appearing in various places throughout the specification are not necessarily all referring to the same embodiment.

Non-Limiting Examples

Although specific embodiments of the disclosure have been disclosed, those having ordinary skill in the art will understand that changes can be made to the specific embodiments without departing from the spirit and scope of the disclosure. The scope of the disclosure is not to be restricted, therefore, to the specific embodiments, and it is intended that the appended claims cover any and all such applications, modifications, and embodiments within the scope of the present disclosure.

It should be noted that some features of the present disclosure may be used in one embodiment thereof without use of other features of the present disclosure. As such, the foregoing description should be considered as merely illustrative of the principles, teachings, examples, and exemplary embodiments of the present disclosure, and not a limitation thereof. Also that these embodiments are only examples of the many advantageous uses of the innovative teachings herein. In general, statements made in the specification of the present application do not necessarily limit any of the various claimed disclosures. Moreover, some statements may apply to some inventive features but not to others.

What is claimed is:

1. A method of forming a planar gate-insulated vacuum channel semiconductor structure, the method comprising:

depositing a conformal hard mask liner over a planar complementary metal-oxide-semiconductor (CMOS) device with a gate stack and a tip-shaped SiGe source/drain region that extend laterally beneath each side of the gate stack;

using shallow trench isolation (STI) to form cavities directly beneath the gate stack;

filling the cavities with dielectric material using oxide deposition;

performing chemical-mechanical planarization (CMP) to a height of the conformal hard mask liner;

performing a first etching using reactive-ion etching along a first direction cutting the gate stack from a top direction down to the tip-shaped SiGe source/drain region;

performing a second etching using wet etching along a second direction perpendicular to the first direction to create a void in a channel in the tip-shaped SiGe source/drain region under the gate stack; and creating a vacuum in the void using physical vapor deposition (PVD) in a region above the tip-shaped SiGe source/drain regions.

2. The method of claim 1, wherein the forming a conformal hard mask liner over a planar complementary metal-oxide-semiconductor (CMOS) device with the gate stack and the tip-shaped SiGe source/drain region formed in a highly doped Si layer.

3. The method of claim 2, wherein the performing a first etching using reactive-ion etching is performed from a top direction down to a SiGe layer containing the tip-shaped SiGe source/drain region.

4. The method of claim 3, further comprising:

forming a contact for each of a source, a gate and a drain.

5. The method of claim 1, wherein the forming a conformal hard mask liner over a planar complementary metal-oxide-semiconductor (CMOS) device with the gate stack and the tip-shaped SiGe source/drain region formed in a silicon on insulator (SOI) layer over a box oxide layer.

6. The method of claim 5, wherein the performing a first etching using reactive-ion etching is performed from a top direction down to the box oxide layer containing the tip-shaped SiGe source/drain region.

7. The method of claim 6, further comprising:

growing the tip-shaped SiGe source/drain region in the void by selective Si or SiGe epitaxy.

8. The method of claim 7, further comprising: forming a contact for each of a source, a gate and a drain.

9. The method of claim 1 is performed with preexisting CMOS fabrication processes.

10. A computer program product for generating integrated circuit designs according to design rules, the integrated circuit designs comprising a planar gate-insulated vacuum channel semiconductor structure, the computer program product comprising a computer readable storage medium having computer readable program code embodied therewith, the computer readable program code, when executed by a processor, cause the processor to perform: depositing a conformal hard mask liner over a planar complementary metal-oxide-semiconductor (CMOS) device with a gate stack and a tip-shaped SiGe source/drain region that extend laterally beneath each side of the gate stack; using shallow trench isolation (STI) to form cavities directly beneath the gate stack; filling the cavities with dielectric material using oxide deposition; performing chemical-mechanical planarization (CMP) to a height of the conformal hard mask liner; performing a first etching using reactive –ion etching along a first direction cutting the gate stack from a top direction down to the tip-shaped SiGe source/drain region; performing a second etching using wet etching along a second direction perpendicular to the first direction to create a void in a channel in the tip-shaped SiGe source/drain region under the gate stack; and creating a vacuum in the void using physical vapor deposition (PVD) in a region above the tip-shaped SiGe source/drain regions.

11. The computer program product of claim 10, wherein the depositing the conformal hard mask liner over a planar complementary metal-oxide-semiconductor (CMOS) device with the gate stack and the tip-shaped SiGe source/drain region formed in a highly doped Si layer.

12. The computer program product of claim 11, wherein the performing a first etching using reactive-ion etching is performed from a top direction down to a SiGe layer containing the tip-shaped SiGe source/drain region.

13. The computer program product of claim 12, further comprising: forming a contact for each of a source, a gate and a drain.

14. The computer program product of claim 10, wherein the depositing the conformal hard mask liner over the planar complementary metal-oxide-semiconductor (CMOS) device with the gate stack and the tip-shaped SiGe source/drain region formed in a silicon on insulator(SOI) layer over a box oxide layer.

* * * * *